United States Patent [19]

Suzuki

[11] Patent Number: 4,646,612

[45] Date of Patent: Mar. 3, 1987

[54] MUSICAL TONE SIGNAL GENERATING APPARATUS EMPLOYING SAMPLING OF HARMONIC COEFFICIENTS

[75] Inventor: Hideo Suzuki, Hamamatsu, Japan

[73] Assignee: Nippon Gakki Seizo Kabushiki Kaisha, Hamamatsu, Japan

[21] Appl. No.: 758,207

[22] Filed: Jul. 23, 1985

[30] Foreign Application Priority Data

Jul. 24, 1984 [JP] Japan ..... 59-153723
Oct. 6, 1984 [JP] Japan ..... 59-210299

[51] Int. Cl.[4] ..... G10H 1/08; G10H 7/00
[52] U.S. Cl. ..... 84/1.22; 84/1.01
[58] Field of Search ..... 84/1.01, 1.11–1.13, 84/1.19–1.23, 1.26

[56] References Cited

U.S. PATENT DOCUMENTS 3,821,714 6/1974 Tomisawa et al. .
3,823,390 7/1974 Tomisawa et al. .
3,888,158 6/1975 Deutsch .
3,913,442 10/1975 Deutsch .
4,132,140 1/1979 Chibana .
4,256,004 3/1981 Takeuchi .
4,352,312 10/1982 Whitefield et al. ..... 84/1.21
4,386,547 6/1983 Chibana .
4,444,082 4/1984 Whitefield ..... 84/1.21

OTHER PUBLICATIONS

Japanese Patent Laid Open Specification No. Sho 55-45056.

*Primary Examiner*—S. J. Witkowski
*Attorney, Agent, or Firm*—Blakely, Sokoloff, Taylor & Zafman

[57] ABSTRACT

In a musical tone signal generating apparatus of a harmonic combination system, the coefficient values of a continuous harmonic to be formed are discretely sampled. Among the sampled values, the values between each two adjacent sampling points (i.e., each two adjacent frames) which vary are selected, and only difference coefficient data therebetween are stored in a memory. When the harmonic coefficient data is to be formed, the difference coefficient data is used for the coefficient varying values between each two adjacent sampling points, and a new coefficient value is calculated. However, as for the nonvarying values between each two adjacent sampling points, no calculation is performed and an already calculated coefficient value is used, thereby updating harmonic coefficients as a function of time, and hence generating a musical tone signal whose tone color is changed as a function of time.

21 Claims, 33 Drawing Figures

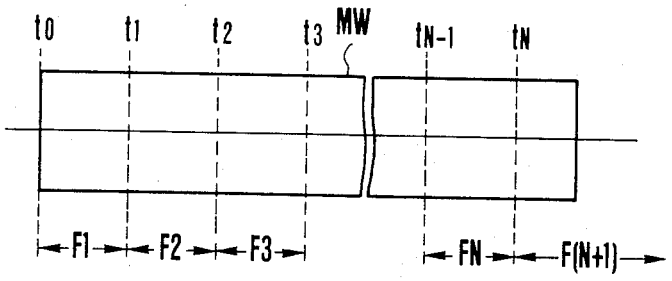
FIG.2
FIG. 3-A
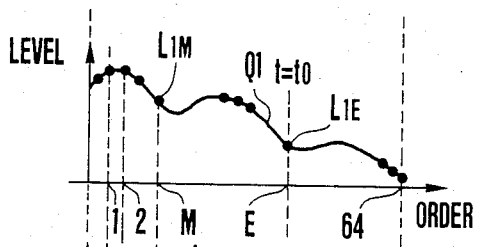
FIG. 3-B
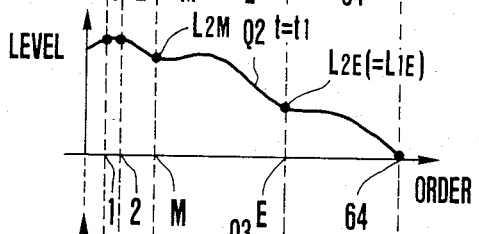
FIG. 3-C
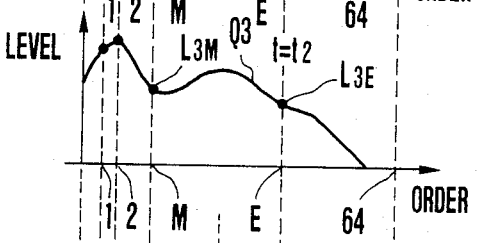
FIG. 3-D
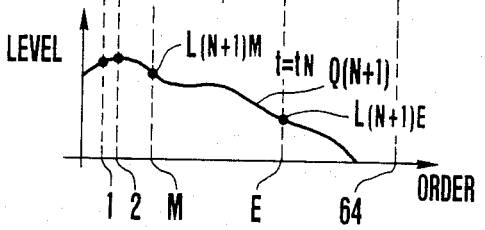

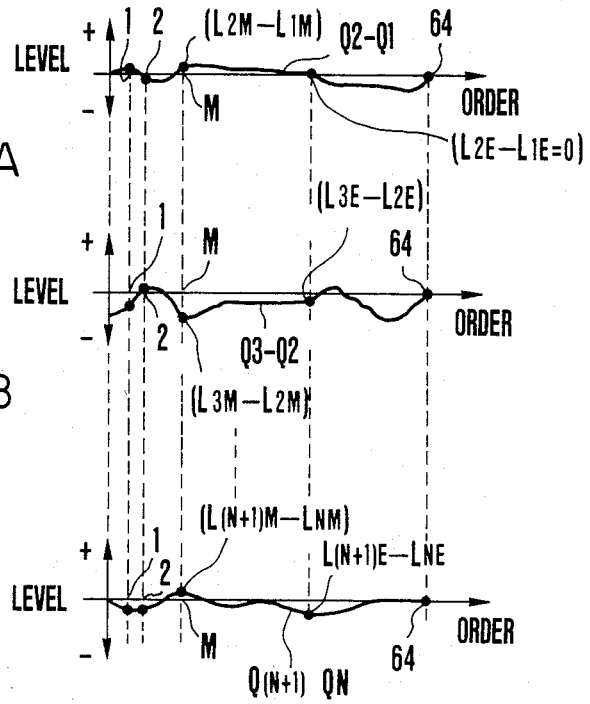
FIG. 4-A
FIG. 4-B
FIG. 4-C

| FRAME | DIFFERENCE COEFFICIENT DATA | | ORDER |
|---|---|---|---|
| F1 | (NO MEMORY AREA) | | |
| F2 | Q2-Q1 | $\Delta SP_{21}$ | 1 |
| | | $\Delta SP_{22}$ | 2 |
| | | ⋮ | ⋮ |
| | | $\Delta SP_{2M}(=L_{2M}-L_{1M})$ | M |
| | | ⋮ | ⋮ |
| | | (NO MEMORY AREA) | (E) |
| | | ⋮ | ⋮ |
| F3 | Q3-Q2 | $\Delta SP_{31}$ | 1 |
| | | $\Delta SP_{32}$ | 2 |
| | | ⋮ | ⋮ |
| | | $\Delta SP_{3M}(=L_{3M}-L_{2M})$ | M |
| | | ⋮ | ⋮ |
| | | $\Delta SP_{3E}(=L_{3E}-L_{2E})$ | E |
| | | ⋮ | ⋮ |
| ⋮ | ⋮ | ⋮ | ⋮ |
| FN | QN-Q(N-1) | $\Delta SP_{N1}$ | 1 |
| | | $\Delta SP_{N2}$ | 2 |
| | | ⋮ | ⋮ |
| | | $\Delta SP_{NM}(=L_{NM}-L_{(N+1)M})$ | M |
| | | ⋮ | ⋮ |
| | | $\Delta SP_{NE}(=L_{NE}-L_{(N-1)E})$ | E |
| | | ⋮ | ⋮ |
| F(N+1) | (NO MEMORY AREA) | | |

FIG.5

| FRAME | DIFFERENCE COEFFICIENT DATA | | ORDER |
|---|---|---|---|
| F1 | $\frac{Q2-Q1}{K1}$ | $\Delta SP_{21}/K1$ | 1 |
| | | $\Delta SP_{22}/K1$ | 2 |
| | | ⋮ | ⋮ |
| | | $\Delta SP_{2M}/K1$ | M |
| | | ⋮ | ⋮ |
| | | (NO MEMORY AREA) | (E) |
| | | ⋮ | ⋮ |
| F2 | $\frac{Q3-Q2}{K2}$ | $\Delta SP_{31}/K2$ | 1 |
| | | $\Delta SP_{32}/K2$ | 2 |
| | | ⋮ | ⋮ |
| | | $\Delta SP_{3M}/K2$ | M |
| | | ⋮ | ⋮ |
| | | $\Delta SP_{3E}/K2$ | E |
| | | ⋮ | ⋮ |
| F3 | $\frac{Q4-Q3}{K3}$ | $\Delta SP_{41}/K3$ | 1 |
| | | $\Delta SP_{42}/K3$ | 2 |
| | | ⋮ | ⋮ |
| | | $\Delta SP_{4M}/K3$ | M |
| | | ⋮ | ⋮ |
| | | $\Delta SP_{4E}/K3$ | E |
| | | ⋮ | ⋮ |
| ⋮ | ⋮ | ⋮ | ⋮ |
| FN | $\frac{QN-Q(N-1)}{KN}$ | $\Delta SP_{(N+1)1}/KN$ | 1 |
| | | $\Delta SP_{(N+1)2}/KN$ | 2 |
| | | ⋮ | ⋮ |
| | | $\Delta SP_{(N+1)M}/KN$ | M |
| | | ⋮ | ⋮ |
| | | $\Delta SP_{(N+1)E}/KN$ | E |
| | | ⋮ | ⋮ |
| F(N+1) | (NO MEMORY AREA) | | |

FIG.6

| | FIRST SERIES DIFFERENCE COEFFICIENT MEMORY | | | SECOND SERIES DIFFERENCE COEFFICIENT MEMORY | | |
|---|---|---|---|---|---|---|
| FRAME | DIFFERENCE COEFFICIENT DATA | | | DIFFERENCE COEFFICIENT DATA | | |
| F1 | NO MEMORY AREA | | ORDER | Q2-Q1 | ⊿SP21 | 1 |
| | | | | | ⊿SP22 | 2 |
| | | | | | ⋮ | ⋮ |
| | | | | | ⊿SP2M(=L2M−L1M) | M |
| | | | | | ⋮ | ⋮ |
| | | | | | NO MEMORY AREA | (E) |
| | | | | | ⋮ | ⋮ |
| F2 | Q2-Q1 | ⊿SP21 | 1 | Q3-Q2 | ⊿SP31 | 1 |
| | | ⊿SP22 | 2 | | ⊿SP32 | 2 |
| | | ⋮ | ⋮ | | ⋮ | ⋮ |
| | | ⊿SP2M(=L2M−L1M) | M | | ⊿S3M(=L3M−L2M) | M |
| | | ⋮ | ⋮ | | ⋮ | ⋮ |
| | | NO MEMORY AREA | (E) | | ⊿S3E(=L3E−L2E) | E |
| | | ⋮ | ⋮ | | ⋮ | ⋮ |
| F3 | Q3-Q2 | ⊿SP31 | 1 | Q4-Q3 | ⊿SP41 | 1 |
| | | ⊿SP32 | 2 | | ⊿SP42 | 2 |
| | | ⋮ | ⋮ | | ⋮ | ⋮ |
| | | ⊿SP3M(=L3M−L2M) | M | | ⊿SP4M(=L4M−L3M) | M |
| | | ⋮ | ⋮ | | ⋮ | ⋮ |
| | | ⊿SP3E(=L3E−L2E) | E | | ⊿SP4E(=L4E−L3E) | E |
| | | ⋮ | ⋮ | | | ⋮ |
| | ⋮ | ⋮ | ⋮ | ⋮ | ⋮ | ⋮ |
| FN | QN-Q(N-1) | ⊿SPN1 | 1 | NO MEMORY AREA | | |
| | | ⊿SPN2 | 2 | | | |
| | | ⋮ | ⋮ | | | |
| | | ⊿SPNM(=LNM−L(N-1)M) | M | | | |
| | | ⋮ | ⋮ | | | |
| | | ⊿SPNE(=LNE−L(N-1)E) | E | | | |
| | | ⋮ | ⋮ | | | |
| F(N+1) | NO MEMORY AREA | | | NO MEMORY AREA | | |

FIG.7

MUSICAL TONE SIGNAL GENERATING APPARATUS EMPLOYING SAMPLING OF HARMONIC COEFFICIENTS

BACKGROUND OF THE INVENTION

The present invention relates to a musical tone signal generating apparatus and, more particularly, to a musical tone signal generating apparatus of a harmonic combination type wherein a fundamental wave and its harmonic wave are generated, and these waves are weighted with the corresponding amplitude coefficients to generate a musical tone signal.

In a conventional musical signal generating apparatus of this type, the amplitude coefficients (to be referred to as harmonic coefficients hereinafter) for controlling the amplitudes of a fundamental wave and harmonic waves (to be referred to harmonic components hereinafter) are properly set to generate musical tone signals having different tone colors.

In a conventional technique as described in, for example, U.S. Pat. No. 3,913,442, the harmonic coefficients of the harmonic components are changed over time to generate a musical tone signal with a tone which changes as a function of time as in an acoustic musical instrument.

In this conventional technique, however, in order to make the amplitudes of harmonic components changeable as a function of time, there is provided an envelope memory (i.e., an attack/decay memory) storing an entire envelope shape of each harmonic component. The number of envelope memories is the same as that of harmonic components. Furthermore, sets of envelope memories must be arranged in units of tone colors. As a result, a large-capacity memory must be used, and the apparatus as a whole becomes large and expensive, resulting in inconvenience.

SUMMARY OF THE INVENTION

It is, therefore, a principal object of the present invention to provide a musical tone signal generating apparatus which requires a small memory capacity as compared with a conventional musical tone signal generating apparatus.

It is another object of the present invention to provide a musical tone signal generating apparatus for generating a musical tone with a tone color changing as a function of time at low cost.

In order to achieve the above object of the present invention, there is provided a musical tone signal generating apparatus of a harmonic combination type, comprising: a musical tone signal generating apparatus of a harmonic combination type, comprising: harmonic waveshape generating means for generating first to Nth (where N is an integer of 2 or more) order harmonic waveshape constituting a musical tone signal to be produced; memory means for storing, (i) a basic coefficient, and (ii) a non-zero difference coefficient whose value is not zero among second to Mth (where M is an integer of 2 or more) difference coefficients together with order data representing order of the non-zero difference coefficient, with respect to each of first to Nth harmonic coefficients, which are functions of time, corresponding to the first to Nth order harmonic waveshapes respectively, each of the first to Nth harmonic coefficients being divided into first to Mth frames along a time axis, and the basic coefficient and the Kth (where K is an integer greater than or equal to 2 and less than or equal to M) difference coefficient respectively having a value representing the first frame and corresponding to the difference between values representing the Kth and (K−1)th frames; frame designating means for sequentially designating one among the first to Mth frames; readout means connected to the memory means for reading out the basic coefficient and the non-zero difference coefficient corresponding to the designated frame by the designating means; forming means for forming each of first to Nth new harmonic coefficients in accordance with the basic coefficient and the non-zero difference coefficient; multiplying means for multiplying the first to Nth order harmonic waveshapes in accordance with the first to Nth new harmonic coefficients respectively and outputting first to Nth multiplication results; and musical tone signal forming means for adding the first to Nth multiplication results to form a musical tone signal corresponding to the musical tone signal to be produced.

BRIEF DESCRIPTION OF THE DRAWINGS

FIG. 2 is a chart showing a signal which represents a musical tone waveshape to be generated;

FIGS. 3A to 3D respectively show spectral distribution curves of harmonic coefficients to be generated;

FIGS. 4A to 4C respectively show spectral distribution curves of difference data to be calculated;

FIG. 5 is a table showing data stored in a difference coefficient generating circuit according to the first embodiment of the present invention;

FIG. 6 is a table showing data stored in an interpolating difference coefficient generating circuit according to a second embodiment of the present invention;

FIG. 7 is a table showing data stored in first and second series difference coefficient generating circuits according to a third embodiment of the present invention;

DESCRIPTION OF THE PREFERRED EMBODIMENTS

Figure 1:
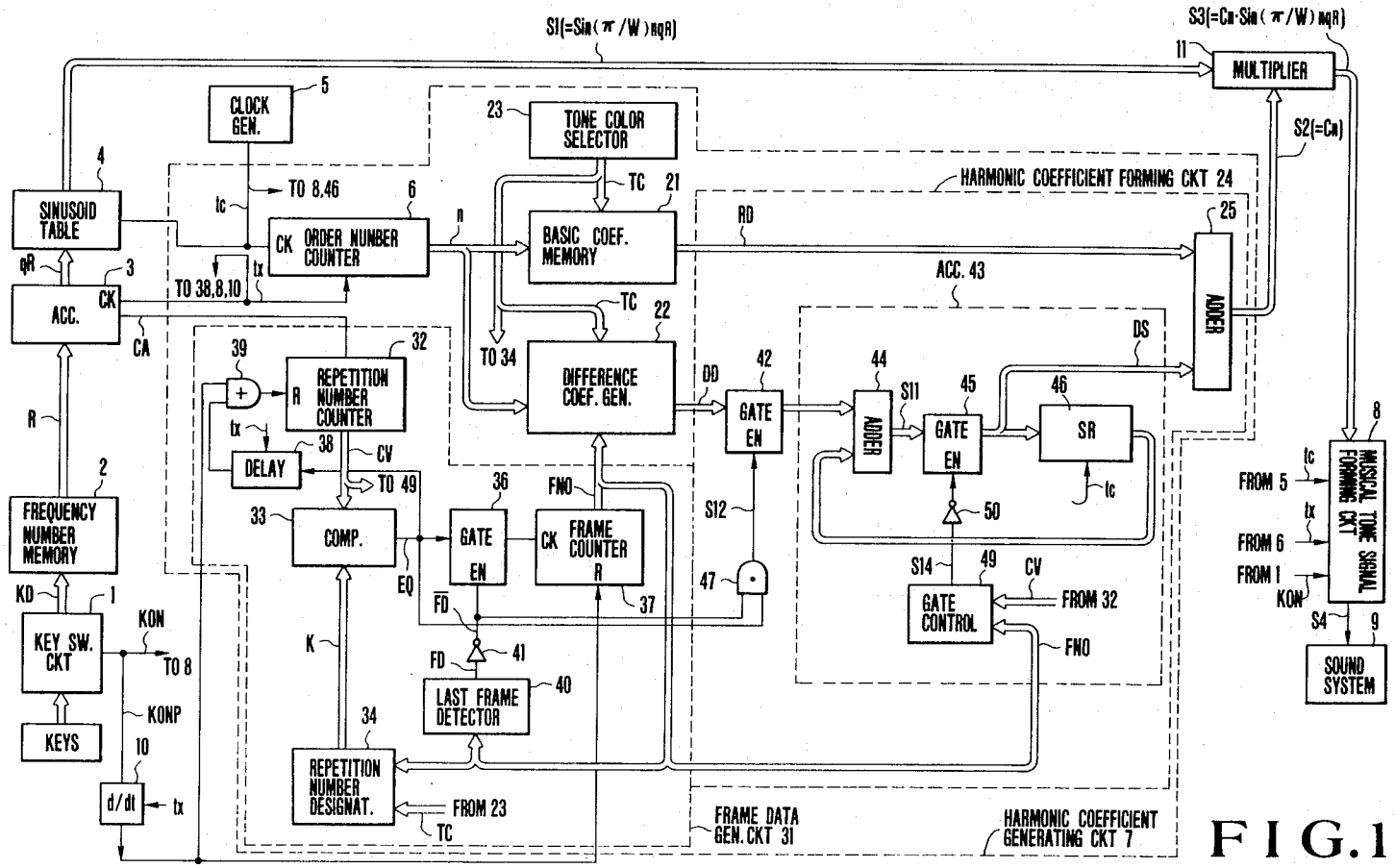
FIG. 1 is a block diagram of a monophonic electrical musical instrument to which a musical tone signal generating apparatus according to a first embodiment of the present invention is applied.

In order to best understand the present invention, the principle of the present invention will first be described hereinafter.

In a musical tone signal generating apparatus of a harmonic combination type, in order to generate a musical tone signal whose tone color is changed as a function of time, the harmonic coefficients must be updated as a function of time. The present invention is based on the following principle so as to constitute a harmonic coefficient which is updated as a function of time.

The coefficient values of a harmonic as a function of time are sampled for each other. The difference between the sampled values at each sampling point and its adjacent sampling point is calculated. The calculated differences are stored in a memory. The harmonic coefficient data are calculated by accumulating corresponding harmonic difference coefficient data at the respective sampling points. If no harmonic difference coefficient data is stored for a given sampling point, accumulation is not performed for this sampling point.

The features of the present invention based on the above principle will be described in detail. Although detailed cases will be exemplified, the present invention is not limited to these.

(1) According to the present invention, a time interval from the beginning to the end of a musical tone signal to be produced is divided into a plurality of frames, as indicated by normalization of the amplitude values. (The amplitude values are given to be constant after an amplitude envelope component is removed). In general, a waveshape MW of the musical tone signal is changed along the time base, and ratios of amplitudes of harmonic components of the respective orders are also changed along the time base. In this case, over a short period of time, a tone color is not greatly changed, so that a predetermined time interval $t_0$ to $t_N$ of an entire time interval from the beginning to the end of a musical tone signal is divided at times $t_1, t_2, \ldots t_{N-1}$ to constitute N frames F1, F2, . . . FN. Since it is well known that most of the tone color variations occur at the start of the attack and after a period of a time, that is time $t_N$ variations of the tone color occur a little, a corresponding last frame F(N+1) is provided.

The relative amplitude levels of the respective harmonic components constituting a musical tone signal have values shown in FIGS. 3A to 3D. At the start time $t_0$ of the first frame F1 of FIG. 2, a set of first to Wth (where W is 64, for example) order harmonic coefficient data Q1 which have a spectral distribution curve of FIG. 3A are generated. At the start time $t_1$ of the second frame F2, a set of first to Wth order harmonic coefficient data Q2 which have a spectral distribution curve of FIG. 3B is generated. In the same manner as described above, the harmonic coefficient data Q3 (FIG. 3C) to Q(N+1) (FIG. 3D) are sequentially generated at times $t_Z$ to $t_N$ respectively.

The harmonic coefficient data Q1 at the time $t_0$ are generated without modification. However, the data Q2 to Q(N+1) are formed through by calculations using difference coefficient data stored in a difference coefficient memory.

In a first embodiment, a difference coefficient memory stores difference coefficient data determined in accordance with differences (Q2−Q1) (FIG. 4A), (Q3−Q2) (FIG. 4B), . . . Q((N+1)−QN) (FIG. 4C) of each two adjacent frames, as shown in FIG. 4. The difference coefficient data are generated at the times $t_1$, $t_2, \ldots t_N$, respectively. The difference coefficient data are accumulated to the data Q1 at the time $t_0$, thereby generating the higher order harmonic coefficient data Q2, Q3, . . . Q(N+1).

According to the present invention, when values of the differences (Q2−Q1), (Q3−Q2), . . . Q((N+1)−QN) are substantially zero, no memory area is assigned to the corresponding orders. In this manner, memory area corresponding to coefficient data having zero value can be eliminated.

The difference coefficient memory is exemplified in FIG. 5. The difference coefficient memory does not have a memory area for the first frame (the harmonic coefficient data Q1 is generated from a basic coefficient memory). When harmonic coefficient values for the orders 1, 2, . . . , M, . . . of the second frame F2 are different from those of the first frame, the coefficient difference memory stores the difference coefficient data Q2−Q1 ($=\Delta SP_{21}, \Delta SP_{22}, \ldots \Delta SP_{2M}$) together with the corresponding order data. However, when the coefficient value of the second frame is equal to that of the first frame with respect to Eth order, no memory area of the second frame F2 is assigned to the Eth order difference coefficient data. More specifically, as shown in FIGS. 3A and 3B, since the harmonic coefficients $L_{1E}$ and $L_{2E}$ of the order E of the first and second frames F1 and F2 are the same, a memory area to be stored difference coefficient data corresponding to the second frame F2 of the order E is not provided in the difference coefficient memory.

Similarly, when the coefficients of a given frame are different from those of the immediately previous frame among the 3rd to Nth frames, the difference coefficient memory stores the difference coefficient data together with the corresponding order data. However, when the coefficients of the given frame are the same as those of the immediately previous frame, the difference coefficient memory does neither store the difference coefficient data of zero value nor the corresponding order data. The difference coefficient memory does not have a memory area for the (N+1)th frame (the harmonic coefficient data at the end of the Nth frame are used without modification in the (N+1)th frame).

In this case, a harmonic coefficient forming circuit adds difference coefficient data read out from the difference coefficient memory for only the order data corresponding to the difference coefficient data of the previous frame at the start times $t_1, t_2, \ldots t_{N-1}$ frames of the second, third, . . . Nth, thereby obtaining harmonic coefficient data Q2, Q3, . . . QN.

Assume the Mth order harmonic coefficient data. This data takes values $L_{1M}$ (FIG. 3A), $L_{2M}$ (FIG. 3B), $L_{3M}$ (FIG. 3C), . . . $L_{NM}$ ($=L_{(N+1)M}$; FIG. 3D) at start times $t_0, t_1, t_2, \ldots t_{N-1}$ of the first, second, third, . . . Nth frames F1, F2, F3, . . . FN. The values $L_{1M}$, $L_{2M}$, $L_{3M}$, . . . $L_{NM}$ are maintained between times $t_0$ and $t_1$, $t_1$ to $t_2$, $t_2$ to $t_3$, . . . $t_{N-1}$ to $t_N$.

The harmonic coefficient data is sequentially changed in a stepwise manner when the difference coefficient data corresponding to orders of the harmonic coefficient data is stored in the difference coefficient memory. However, when difference coefficient data for the remaining orders of the harmonic coefficient data is not stored, the harmonic coefficient data will not be changed.

According to the second embodiment, interpolation is performed to smoothly change the respective harmonic coefficient data $Q_1$ to $Q_2$, $Q_2$ to $Q_3$, . . . QN to Q(N+1) generated for time intervals between $t_0$ to $t_1$, $t_1$ to $t_2$, . . . $t_{N-1}$ to $t_N$.

In this case, the difference coefficient data comprises data representing a value obtained by dividing difference coefficient data as a difference by an interpolation repetition number of each frame. The resultant data is stored together with the order data in the memory means. The forming circuit sequentially accumulates the difference coefficient data to the basic coefficient data in accordance with the interpolation operation timings. This operation is performed for every order represented by the order data.

As shown in FIG. 6, the difference coefficient memory stores difference coefficient data $(Q2-Q1)/K_1$, $(Q3-Q2)/K_2$, . . . $(QN-Q(N-1))/K_N$ for each of the frames F1 to FN. The difference coefficient data are obtained by dividing the difference coefficient data (Q2−Q1), (Q3−Q2), . . . (QN−Q(N−1)) by the interpolation repetition numbers $K_1$, $K_2$, . . . $K_N$. The resultant difference coefficient data $(Q2-Q1)/K_1$, $(Q3-Q2)/K_2$, . . . $(QN-Q(N-1))/K_N$ are read out for each of the frames F1 to FN. The readout difference coefficient data are sequentially accumulated by the forming circuit for the harmonic coefficient data Q1 at the time $t_0$, thereby forming smoothly gradually changing harmonic coefficient data for each of the frames F1 to FN.

The harmonic coefficient data is smoothly stepwisely changed from the coefficient value at the beginning of the given frame to that at the beginning of the next frame by interpolating for each order in each frame.

The Mth harmonic coefficient data will be described in detail with reference to FIG. 6. When the value $L_{1M}$ (FIG. 3A) at the time $t_0$ of the first frame F1 is changed to the value $L_{2M}$ (FIG. 3B) at the time $t_1$, the difference coefficient data has a value $(L_{2M}-L_{1M})/K_1$ obtained by dividing the difference $(L_{2M}-L_{1M})$ (FIG. 4A) by the interpolation repetition number $K_1$ of the first frame F1. When interpolation is repeated between the time $t_0$ and $t_1$ (i.e., during the first frame F1), the value of the Mth order harmonic coefficient data is gradually changed from $L_{1M}$ to $L_{2M}$ by every interpolation difference $(L_{2M}-L_{1M})/K_1$. The value of the Mth order harmonic coefficient data is $L_{2M}$ at the time $t_1$.

Similarly, a value $(L_{3M}-L_{2M})/K_2$ obtained by dividing a difference $(L_{3M}-L_{2M})$ (FIG. 4B) between the values $L_{3M}$ and $L_{2M}$ (FIGS. 3C and 3B) by the interpolation repetition number $K_2$ of the second frame F2 is stored as the difference coefficient data of the second frame F2 (i.e., the interval between the times $t_1$ and $t_2$). A value $(L_{(N+1)/M}-L_{MN})/K_N$ obtained by dividing a difference $(L_{(N+1)M}-L_{MN})$ between the values $L_{(N+1)M}$ and $L_{NM}$ of the Nth frame FN (i.e., an interval between the times $t_{N-1}$ and $t_N$) by an interpolation repetition number $K_N$ of the Nth frame FM is stored as the difference coefficient data of the Nth frame FN between the times $t_{N-1}$ and $t_N$.

The Mth order harmonic coefficient data is changed from the value $L_{2M}$ at the time $t_1$ of the second frame F2 by every interpolation difference $(L_{3M}-L_{2M})/K_2$ and has the value $L_{3M}$ at the time $t_2$. During the Nth frame, the data is smoothly changed by every interpolation difference $(L_{(N+1)M}-L_{NM})/K_N$ from the value $L_{MN}$ at the time $t_{N-1}$ and reaches the value $L_{(N+1)M}$ at the time $t_N$.

(2) Furthermore, according to the present invention, the harmonic coefficient data of the currently processed in the same manner as described above is generated as a first series of harmonic coefficient data. At the same time, the harmonic coefficient data of the subsequent frame is generated as a second series of harmonic coefficient data.

The second series of harmonic coefficient data is sequentially weighted with a corresponding harmonic coefficient during the corresponding frame. Thus, the smooth changing harmonic data is obtained such that its value is gradually changed from that of the first series of harmonic coefficient data to that of the second series of harmonic coefficient data. The harmonic coefficient will not be rapidly changed when the current frame is changed to the next frame.

In this case, when the orders which are not changed between each two adjacent frames when updating of the harmonic coefficient data Q1, Q2, Q3, . . . Q(N+1) are present, the difference coefficient data of these orders are not stored in the difference coefficient memory, thereby decreasing the memory capacity of the difference coefficient memory.

In this case, in order to generate the first series of harmonic coefficient data in parallel with the second series of harmonic coefficient data, two difference coefficient data must be generated for the first and second series of data. For this purpose, the difference coefficient memory comprises first and second series difference coefficient memories. As shown in FIG. 7, the first series difference coefficient memory stores the difference coefficient data in the same manner as in FIG. 5.

However, as shown in FIG. 7, the second series difference coefficient memory stores the difference coefficient data associated with the frames F2 to FN of the first series difference coefficient memory so as to correspond to the frames F1 to F(N−1).

One of the difference frame memories can be omitted. In this case, the difference coefficient data of each two adjacent frames is time-divisionally read out to obtain the same effect as in the arrangement with two memories.

Instead of combining the weighted first and second series of harmonic coefficient data, the first series of harmonic coefficient data may be combined with the weighted second series of harmonic coefficient data to obtain the same result.

(3) With the above arrangement, the following effect is obtained. The data required for generating the harmonic coefficients of the respective orders which vary along the time base comprise only the set (first to Wth order) of harmonic coefficient data at the beginning of the musical tone signal and a set of difference coefficient data used in each frame. In addition, the difference coefficient data have sufficiently small values. As a result, the memory capacity can be decreased as a whole. Furthermore, only the difference data corresponding to the orders for changing the harmonic coefficients are stored in the memory. Therefore, the memory capacity can be further decreased.

The frame classification can be identical for each order (as in the above embodiment). The frame classifications may vary depending on the respective orders.

FIRST EMBODIMENT

FIG. 1 is a block diagram showing a monophonic electronic musical instrument to which a musical tone signal generating apparatus of the present invention is applied. The difference coefficient data shown in FIG. 5 are accumulated when the frame number is increased, thereby generating harmonic coefficient data.

In this embodiment, an amplitude $X_0(qR)$ of each sampled point qR of a musical tone signal (i.e., a musical tone waveshape) corresponding to a key depressed on the keyboard is calculated for each regular time interval (i.e., a sampling time) $t_X$ as follows:

$$X_0(qR) = \sum_{n=1}^{W} A(t)\, Cn \sin(\pi/W)nqR \tag{1}$$

where q is the variable incremented for each time interval $t_X$ to be 1, 2, . . . , and n is the order of each harmonic component including a fundamental wave, n=1 is the fundamental wave, n=2 is the second harmonic, . . . and n=W (where W=64 in this embodiment) is the Wth harmonic, R is the value (to be referred to as a frequency number) corresponding to fundamental frequency (pitch) of the musical tone, A(t) is the envelope function for setting an amplitude envelope of the musical tone, and Cn is the harmonic coefficient of the nth harmonic component.

Referring to FIG. 1, reference numeral 1 denotes a key switch circuit. Key data KD corresponding to a depressed key is supplied to a frequency number memory 2. A frequency number R having a value corresponding to the pitch of the depressed key is read out and supplied to an accumulator 3. The accumulator 3 accumulates the frequency numbers R every time a calculation interval timing signal $t_X$ is supplied to a clock terminal CK thereof. The accumulated data qR (q=1, 2, . . . ) is supplied as phase data for designating a present phase angle value of the musical tone waveshape to a sinusoid table 4.

Figure 8:
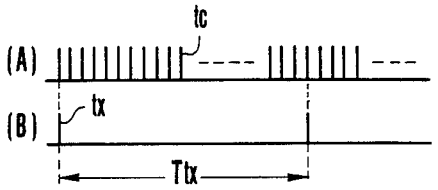
FIGS. 8A and 8B respectively show the relationship between a clock signal $t_C$ and a calculation interval timing signal $t_X$.

Reference numeral 5 denotes a clock generator. A clock signal $t_C$ from the clock generator 5 is supplied to an order number counter 6 of modulo-64. A timing signal $t_X$ is generated from the carry output terminal of the order number counter 6. As shown in FIG. 8A, 64 clock signals $t_C$ are generated for every timing signal $t_X$ (FIG. 8B). Therefore, one period $T_{tX}$ of the timing signal $t_X$ is divided into 64 time slots corresponding to the first to 64th harmonic components in response to the 64 clock signals $t_C$.

The sinusoid table 4 generates sinusoid data S1 for the first to 64th harmonic components in the respective time slots set in response to the clock signals $t_C$:

$$S1 = \sin((\pi/W)nqR) \tag{2}$$

The sinusoid data S1 is supplied to a multiplier 11. The sinusoid table 4 can comprise one described in U.S. Pat. Nos. 3,913,442 or 4,386,547.

Harmonic coefficient data S2 corresponding to a harmonic coefficient Cn given in equation (1) is supplied from a harmonic coefficient generating circuit 7 to the multiplier 11. The multiplier 11 multiplies the sinusoid data S1 with the harmonic coefficient data S2 and supplies multiplication output data S3 to a musical tone signal forming circuit 8.

The musical tone signal forming circuit 8 adds the data S on the basis of the clock signal $t_C$ and the timing signal $t_X$ to form a musical tone signal. The circuit 8 also adds the predetermined envelope to the musical tone signal in accordance with the key-on signal KON from the key switch circuit 1, thereby generating a musical tone signal S4 given by equation (1). The signal S4 is converted by a sound system 9 to a musical tone. The musical tone signal forming circuit 8 can be one described in U.S. Pat. No. 4,256,004 or Japanese Patent Preliminary Publication No. 55-45056.

Figure 9:
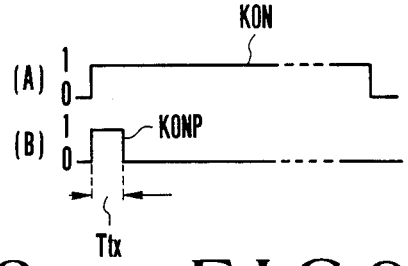
FIGS. 9A and 9B respectively show the relationship between a key-on signal KON and a key-on pulse signal KONP.

In this embodiment, when each key switch is depressed, the key switch circuit 1 generates the key-on signal KON which is set at logic "1" until the depressed key is released, as shown in FIG. 9A. A differentiating circuit 10 receives the timing signal $t_X$ as a trigger signal on the basis of the leading edge of the key-on signal KON, and generates a key-on pulse signal KONP (FIG. 9B) having the period $T_{tX}$ of the timing signal $t_X$.

The harmonic coefficient generating circuit 7 has a basic coefficient memory 21 for storing basic coefficient data RD equal to harmonic coefficient data at t=t0 as described with reference to FIG. 3A and a difference coefficient generating circuit 22 for generating the above described, difference coefficient data (Q2−Q1), (Q3−Q2), . . . (Q(N+1)−QN) described with reference to FIGS. 4A to 4C and FIG. 5. The basic coefficient memory 21 and the difference coefficient generating circuit 22 store such data corresponding to each of tone colors. The basic coefficient data RD and the difference coefficient data DD are read out in accordance with a tone color selection signal TC representing a tone color selected by a tone color selector 23.

The basic coefficient memory 21 stores basic coefficient data (FIG. 3A) representing amplitude coefficient values for respective order components included in the beginning of the musical tone signal. The basic coefficient memory 21 receives order data n as an address signal which represents the count of the order number counter 6. The first to 64th basic coefficient data RD are sequentially read out in accordance with the order data n. The readout data is supplied as an addition input data to an adder 25 of a forming circuit 24.

Figure 10:
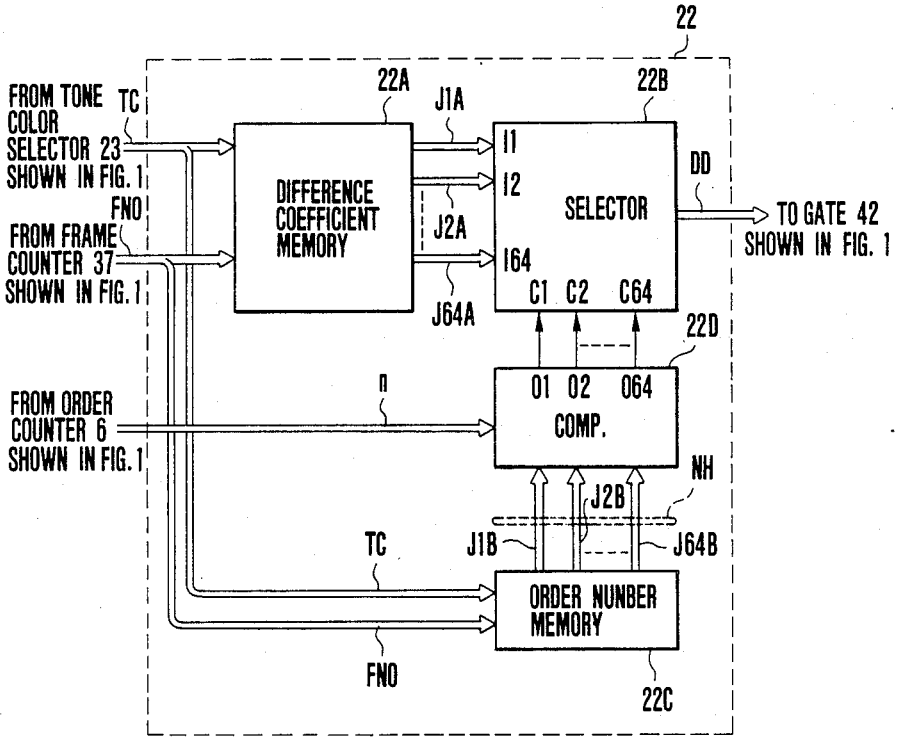
FIG. 10 is a block diagram showing a detailed arrangement of the difference coefficient generating circuit of FIG. 1.

As shown in FIG. 10, the difference coefficient generating circuit 22 comprises a difference coefficient memory 22A and an order memory 22C which receive the tone selection signal TC and frame designating data FNO as an address signal generated from a frame data generating circuit 31 (FIG. 1). The difference coefficient memory 22A stores the difference coefficient data for the frames F2 to FN shown in FIG. 5. The difference coefficient data of predetermined orders for a frame designated by the frame designating data FNO are simultaneously read out, and the readout parallel data are sent onto lines J1A, J2A, . . .

The order memory 22C stores the order data (FIG. 5) as the changing order data for the frames F2 to FN in the same manner as in the coefficient memory 22. The changing order data of a frame designated by the frame designating data FNO are simultaneously read out. The readout parallel data are sent onto lines J1B, J2B, . . . The data appearing on the lines J1A and J1B and the lines J2A and J2B are given in a one-to-one correspondence. The orders of the difference coefficient data on the lines J1A, J2A, . . . are respectively determined by the necessary order data NH appearing on the line J1B, J2B, . . .

For example, in the case shown in FIG. 5, the difference coefficient data $\Delta SP_{21}$, $\Delta SP_{22}$, . . . of the second frame F2 respectively appear on the lines J1A, J2A, . . . , and necessary order data NH which represent the first order, the second order, . . . respectively appear on the lines J1B, J2B, . . .

A comparator 22D compares the necessary order data HN and the order data n which respectively appear on the lines J1B, J2B, . . . When a coincidence is established between the changing order data HN and the order data n, signals of logic "1" appear on the corresponding output terminals 01, 02, . . . For example, in the case of FIG. 5, the changing order data NH of the second frame F2 which appears on the line J1B represents the first order. When the order data n represents the first order, i.e., during the time slot of the first harmonic component, a signal of logic "1" appears at the output terminal 01.

In this manner, the signals of logic "1" during the time slots corresponding to the orders represented by the necessary order data NH appearing on the lines J1B, J2B, . . . are generated from the output terminals 01, 02, . . . of the comparator 22D.

A selector 22B selects the difference coefficient data supplied to input terminals I1, I2, . . . when signals of logic "1" are supplied to control terminals C1, C2, . . . thereof, thereby generating the difference coefficient data DD.

As a result, the difference coefficient data of predetermined orders which are read out from the difference coefficient memory 22A are generated as the difference coefficient data DD assigned to the corresponding time slots.

As for the orders whose data are not stored in the difference coefficient memory 22A and the order memory 22C, the content of the difference coefficient data DD during the corresponding time slot becomes zero.

The frame data generating circuit 31 comprises a repetition number counter 32 for counting the musical tone waveshape repetition number during one frame. The counter 32 is started in response to the carry signal CA generated from the accumulator 3. When the accumulated value of the accumulator 3 exceeds a maximum value (i.e., when the data in the accumulator 3 are set at all "0" or "1" data), the accumulator 3 generates a carry signal CA. More specifically, the accumulator 3 accumulates the frequency numbers R. When a time corresponding to one period of the musical tone waveshape has elapsed, the accumulated value reaches the maximum value. The repetition number counter 32 is incremented every time the time corresponding to one period of the musical tone waveshape has elapsed. As a result, the count of the repetition number counter 32 represents the musical tone waveshape repetition number of each frame, i.e., the repetition operation number of the forming circuit 24. The count of the repetition number counter 32 is generated as a repetition number count data CV.

The repetition number data CV from the repetition number counter 32 is supplied to a comparator 33 and is compared with the repetition number designating data K appearing at the output terminal of a repetition number designating circuit 34. As a result, when a coincidence is established between the data CV and K, the comparator 33 supplies a coincidence signal EQ to a count input terminal CK of a frame counter 37 through a gate circuit 36. The coincidence signal EQ is also supplied to a reset input terminal R of the repetition number counter 32 through an OR gate 39 via a delay circuit 38. The key-on pulse signal KONP is supplied to the reset input terminal R of the repetition number counter 32 through the OR gate 39, thereby resetting the repetition number counter 32.

As described with reference to FIGS. 2 and 5, the repetition number designating circuit 34 has a memory for storing repetition numbers $K_1$, $K_2$, . . . $K_N$ of each tone so as to correspond to the first to Nth frames F1 to FN. The repetition number data is read out in response to the tone color selection signal TC and the frame designating data FNO generated from the frame counter 37. The readout data is generated as the repetition number designating data K. When the repetition number designated by the repetition number designating data K generated for each frame from the repetition number designating circuit 34 compared by the comparator 33 coincides with the content of the repetition number count data CV of the repetition number counter 32 (i.e., every time each frame is ended), the coincidence detection output EQ is generated to reset the repetition number counter 32, and at the same time, the frame counter 37 is started through the gate circuit 36.

The key-on pulse signal KONP is supplied as a reset signal to the frame counter 37. The content of the frame counter 37 is generated as the frame designating data FNO.

The frame designating data FNO is supplied from the frame counter 37 to a last frame detector 40. The last frame detector 40 generates a last frame detection output FD which is set at logic "1" when the frame designating data FNO represents the (N+1)th frame. The output FD is supplied as an inverted output $\overline{FD}$ to the enable terminal of the gate circuit 36 through an inverter 41. Therefore, the last frame FN is ended. When the frame designating data FNO represents the (N+1)th frame, the gate circuit 36 is disabled, thereby stopping the frame counter 37 so as not to update the frame designating data FNO.

The difference coefficient generating circuit 22 sequentially generates a set (i.e., the first to 64th orders) of difference coefficient data DD of the frame designated by the frame designating data FNO. These difference coefficient data DD are sequentially supplied to an adder 44 in an accumulator 43 through a gate circuit 42. The difference coefficient data DD from the difference coefficient generating circuit 22 can be positive or negative. The adder 44 adds the positive and negative difference coefficient data.

A sum output S11 from the adder 44 is supplied to a 64-stage shift register 46 through a gate circuit 45. The shift register 46 shifts the data in response to the clock signal $t_C$. When the sum outputs S11 for the first to 64th harmonics are sequentially received, the shift register 46 sequentially receives and shifts these data. Within the 64 time slots, the output is fed back to the other sum input of the adder 44.

A control signal S12 is supplied from an AND gate 47 to the enable terminal of the gate circuit 42. The AND gate 47 generates the control signals 12 when the coincidence detection output EQ from the comparator 33 is set at logic "1" under the condition wherein the inverted output $\overline{FD}$ from the inverter 41 is set at logic "1" (i.e., the last frame is not detected).

When the comparator 33 generates the coincidence detection output EQ, the output EQ is delayed by the delay circuit 38 by one period (one calculation interval $T_{tX}$ of the timing signal $t_X$. The delayed signal is supplied to the repetition counter 32 which is then reset. The coincidence detection signal EQ is generated from the comparator 33 for one calculation interval $T_{tX}$. As a result, the gate circuit 42 is enabled for the one calculation interval $T_{tX}$ in synchronism with the coincidence detection output EQ. When the next frame is initiated, the first to 64th order difference coefficient data DD are supplied from the difference coefficient generating circuit 22 to the accumulator 43 through the gate circuit 42 for the one calculation interval $T_{tX}$.

As a result, the adder 44 sequentially adds the difference coefficient data DD supplied through the gate circuit 42 to the one-frame preceding sum output S11. In this manner, the accumulator 43 accumulates once for the one calculation interval $T_{tX}$ at the beginning of each of the frames F2 to FN the difference coefficient data DD of the respective orders which are supplied from the difference coefficient generating circuit 22.

The accumulation data appears at the output terminal of the gate circuit 45 and is supplied as the difference accumulation coefficient data DS to the adder 25. The difference accumulation coefficient data DS is added by the adder 25 to the basic coefficient data RD. The resultant sum is supplied as the harmonic coefficient data S2 of the harmonic coefficient generating circuit 7 to the multiplier 11.

The gate circuit 45 receives a control signal S14 from a gate control circuit 49 through an inverter 50. The gate control circuit 49 receives the repetition number count data CV from the repetition number counter 32 and the frame designating data FNO from the frame counter 37. When the frame designating data FNO is set at logic "1" (the first frame F1 is designated) or the repetition number count data CV is set at logic "0" (a new frame is started), the gate control circuit 49 generates the control signal S14 of logic "1". The gate circuit 45 is disabled for one period of the first musical tone waveshape of the first frame F1. As a result, the difference accumulation coefficient data DS is not supplied to the adder 25, and at the same time, the storage data in the respective stages of the shift register 46 are cleared.

Figures 11A, 11B, 11C, 11D, 11E, 11F:
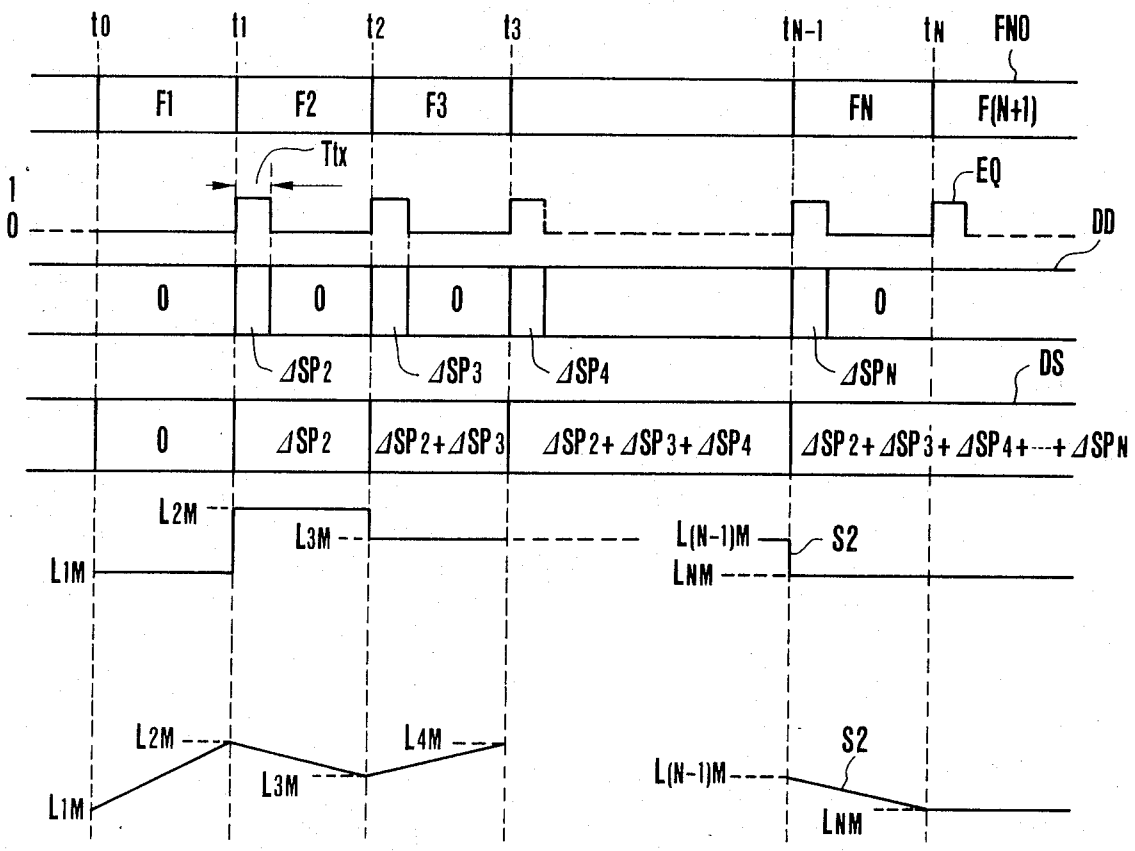
FIGS. 11A to 11F respectively timing charts of the respective signals in the arrangement of FIG. 1.

With the above arrangement, when a key is depressed at the time $t_0$ of FIG. 11, the repetition number counter 32 and the frame counter 37 are reset in response to the key-on pulse signal KONP generated through the differentiating circuit 10. The frame designating data FNO (FIG. 11A) designates the first frame F1, and the repetition number count data CV is 0.

The frequency number R corresponding to the depressed key is supplied to the accumulator 3. The sinusoid data S1 of the first to 64th order harmonic components at a pitch corresponding to the frequency number R are sequentially generated from the sinusoid table 4 in response to the clock signal $t_C$ and are supplied to the multiplier 11.

The order number counter 6 is started in response to the clock signal $t_C$ supplied from the clock generator 5. The order data n is supplied as an address data to the basic coefficient memory 21 and the difference coefficient generating circuit 22. The basic coefficient data RD comprising the harmonic coefficient data Q1 (FIG. 3A) at the beginning of the tone produced by the first to 64th order harmonics are sequentially read out from the basic coefficient memory 21 and supplied to the adder 25. However, since the memory area for the first frame is not assigned to the difference coefficient memory 22A (FIG. 10) in the difference coefficient generating circuit 22, as described with reference to FIG. 5, the difference coefficient data DD is not generated from the difference coefficient generating circuit 22 (FIG. 11C).

In this case, in the accumulator 43 of the harmonic coefficient generating circuit 7, the gate control circuit 49 generates the control signal S14 of logic "1" when the data CV is set at logic "0" and the frame designating data FNO is set at logic "1", thereby disabling the gate circuit 45. Therefore, the accumulator 43 is controlled so as not to generate the difference accumulation coefficient data. At the same time, the contents of the respective stages of the shift register 46 are cleared.

In this case, since the coincidence detection output EQ (FIG. 11B) supplied to the AND gate 47 is set at logic "0" (i.e., no coincidence is detected by the comparator 33), the gate circuit 42 is kept disabled. Therefore, the difference coefficient data DD is not supplied to the accumulator 43.

In this manner, upon depression of a key (i.e., at the beginning of the first frame F1), only the basic coefficient data RD is supplied from the basic coefficient memory 21 to the adder 25. This data is supplied as the harmonic coefficient data S2 to the multiplier 11.

In this state, the order number counter 6 generates the calculation interval timing signal $t_X$ every time it counts 64 clocks $t_C$. In response to the signal $t_X$, the accumulator 3 supplies to the sinusoid table 4 the accumulation data qR which sequentially designates the sampling positions of the musical tone waveshape. The sinusoid table 4 sequentially time-divisionally generates the sinusoid data S1 of the first to 64th harmonic components during the first to 64th time slots formed by the clock signal $t_C$. The sinusoid data S1 are sequentially supplied to the multiplier 11.

The first to 64th harmonic coefficient data Q1 (FIG. 3A) are sequentially read out from the basic coefficient memory 21 in response to the clock signal $t_C$ and are supplied as the harmonic coefficient data S2 to the multiplier 11 through the adder 25. The multiplier 11 generates the multiplication data output S3 obtained by multiplying the first to 64th harmonic coefficient data with the sampling point amplitude values of the first to 64th harmonic components of the first period of the musical tone waveshape.

When the accumulator 3 completes the accumulation for one period of the musical tone waveshape and generates the carry signal CA, the repetition number counter 32 is started to change the count data CV from 0 to 1. In this case, the output from the gate control circuit 49 goes logic "0", thereby enabling the gate circuit 45.

In this case, the difference coefficient generating circuit 22 does not generate the difference coefficient data DD. Furthermore, since the coincidence detection output EQ is kept at logic "0", the gate circuit 42 is kept disabled. Therefore, the accumulator 43 does not generate the difference accumulation coefficient data DS.

In the same manner as described above, every time one period of the musical tone waveshape has elapsed, the carry signal CA is supplied from the accumulator 3 to the repetition number counter 32. The value of the repetition number count data CV is incremented one by one. However, the frame designating data FNO from the frame counter 37 does not change, and the coincidence detection output EQ does not change either.

Therefore, the difference coefficient generating circuit 22 will not generate the difference coefficient data DD, and the gate circuit 42 is kept disabled.

During the first frame F1, only the basic coefficient data RD is generated as the harmonic coefficient data S2 from the adder 25. As a result, the tone color of the musical tone generated by the sound system 9 during the first frame is determined by the basic coefficient data RD.

At the time $t_1$ of FIG. 11, when the count of the repetition number counter 32 coincides with the repetition number K ($=K_1$) designated by the repetition number designating circuit 34, the coincidence detection output EQ (FIG. 11B) from the comparator 33 goes logic "1" during the one calculation interval $T_{tX}$. In this case, the coincidence detection output EQ is supplied to the frame counter 37 through the gate circuit 36, and the frame counter 37 is started to change the content of the frame designating data FNO from 1 to 2 (FIG. 11A). The harmonic coefficient generating circuit 7 stops generating the coefficients of the first frame F1, thereby initiating the second frame F2.

At the same time, the coincidence detection output EQ is delayed by the delay circuit 38 by one calculation interval $T_{tX}$. The delayed signal resets the repetition number counter 32 through the OR gate 39, and the repetition number count data CV is reset to zero.

In this case, since the frame designating data FNO is updated to 2, the difference coefficient memory 22A (FIG. 10) in the difference coefficient generating circuit 22 is controlled to read out as the difference coefficient data DD, the difference coefficient (Q2−Q1) (FIG. 5) corresponding to the second frame F2.

The coincidence detection output EQ is obtained for the one calculation interval $T_{tX}$, and then the difference coefficient data $\Delta SP_{21}, \Delta SP_{22}, \ldots, \Delta SP_{2M}, \ldots$ (FIG. 5) of the respective orders are sequentially generated from the difference coefficient generating circuit 22 to the accumulator 43 through the gate circuit 42. The difference coefficient data $\Delta SP_{21}, \Delta SP_{22}, \ldots \Delta SP_{2M}, \ldots$ are sequentially stored in the shift register 46 through the adder 44 and the gate circuit 45. The suffix of the difference coefficient data of each order is omitted in FIGS. 11C and 11D.

When the one calculation interval $T_{tX}$ has elapsed, the coincidence detection output EQ goes logic "0" to disable the gate circuit 42 (FIG. 11B). Therefore, the content of the shift register 46 is cyclically stored through the adder 44 and the gate circuit 45. At the same time, the content is repeatedly supplied as the difference accumulation coefficient data DS from the output terminal of the gate circuit 45 to the adder 25 (FIG. 11D).

The adder 25 adds the difference accumulation coefficient data DS to the basic coefficient data RD of the respective orders and generates the sum as the harmonic coefficient data S2. The harmonic coefficient data S2 is stepped up by the difference coefficient data (Q2−Q1) (FIG. 4A) from the coefficient value Q1 (FIG. 3A) to the coefficient value Q2 when the first frame F1 is changed to the second frame F2.

For example, for the Mth harmonic coefficient, as shown in FIG. 11E, the coefficient $L_{1M}$ is updated to $L_{2M}$ when the second frame F2 is initiated at the time $t_1$. The value $L_{2M}$ is maintained up to the time $t_2$ at which the third frame F3 is initiated.

The difference coefficient memory 22A (FIG. 10) does not store difference coefficient data for the order whose amplitude coefficient does not change. For example, in the case of FIGS. 3 to 5, no amplitude change occurs in the Eth order component in the second frame F2, so no memory area is assigned thereto. The difference coefficient generating circuit 22 does not generate the difference coefficient data DD during the Eth order time slot (DD=0). As a result, the Eth order harmonic coefficient data S2 does not change even if the second frame F2 is initiated and maintains the same value as that of the first frame F1.

The same operation as described above is repeated in the third to Nth frames F3 to FN, so that the accumulator 43 accumulates the difference coefficient data DD generated from the difference coefficient generating circuit 22 every time the frame is initiated (FIG. 11D). In response to this operation, the harmonic coefficient data S2 is changed over time, as indicated for the Mth order data in FIG. 11E.

When the Nth frame FN is ended at the time $t_N$ of FIG. 2, the content of the frame designating data FNO is updated to (N+1) which is detected by the last frame detector 40. The gate circuit 36 is disabled in response to the detection output FD from the detector 40. Subsequently, counting operation of the frame counter 37 is stopped, thereby stopping updating of the frame designating data FNO.

In this case, the difference coefficient generating circuit 22 does not generate the difference coefficient data DD (FIG. 5). At the same time, the gate circuit 42 is disabled. The accumulator 43 does not perform subsequent accumulation. The accumulation result of the Nth frame is stored in the accumulator 43 during the (N+1)th frame.

The tone color of the musical tone generated from the sound system 9 is maintained until the depressed key is released.

With the arrangement shown in FIG. 1, the amplitudes of the respective harmonic components included in the musical tone signal can vary in respective frames. Therefore, musical tones similar to an acoustic musical instrument can be generated from the sound system 9. The basic coefficient memory 21 must store only a set of the first to 64th order harmonic coefficient data Q1 (FIG. 4A). Other storage data comprise a set of difference data which have small amplitude change throughout the frames and which are stored in the difference coefficient memory 22A. Therefore, the memory capacity of the harmonic coefficient generating circuit 7 as a whole can be decreased.

In addition, the difference coefficient memory 22A does not have a memory area for storing difference coefficient data having zero value. Thus, the memory capacity of the coefficient memory 22A can be considerably decreased.

SECOND EMBODIMENT

Figure 12:
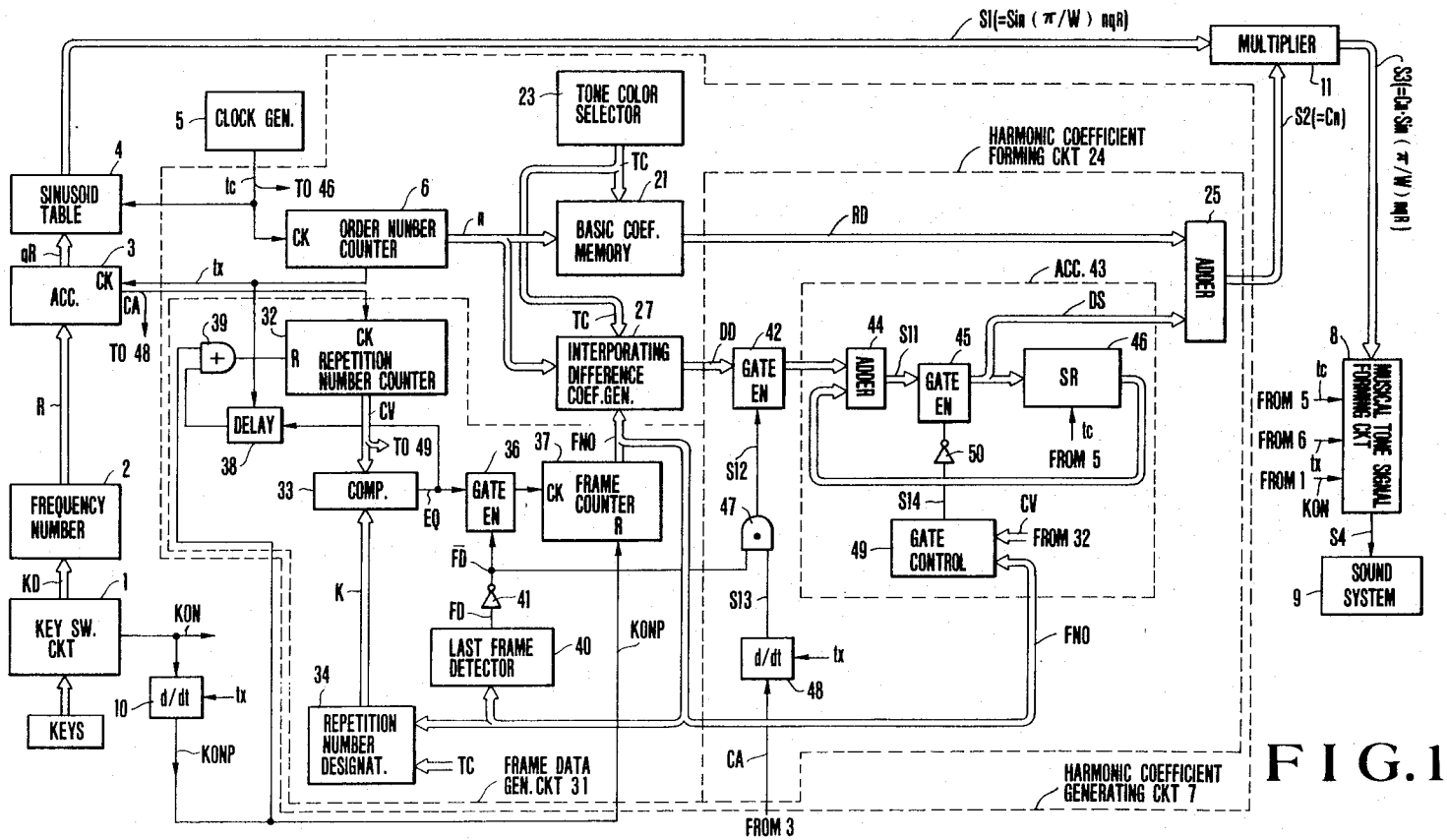
FIG. 12 is a block diagram of a musical tone signal generating apparatus according to the second embodiment of the present invention.

FIG. 12 shows another embodiment of the present invention. Difference coefficient data comprises interpolating difference data for each frame. The corresponding interpolating difference data is read out during each frame, thereby performing interpolation. In this case, the harmonic coefficient data which is changed over time within each frame is generated.

Referring to FIG. 12, the same reference numerals as in FIG. 12 denote the same parts in FIG. 1. A difference coefficient data generating means has an interpolating difference coefficient generating circuit 27. As described with reference to FIGS. 4A to 4C and FIG. 6, the interpolating difference coefficient generating circuit 27 stores as interpolating difference data values obtained by dividing the difference data (Q2−Q1), (Q3−Q2), . . . (QN−Q(N−1)) of the first frame F1, the second frame F2, . . . the Nth frame FN by interpolation repetition numbers $K_1$, $K_2$, . . . $K_N$. The respective interpolating difference data are sequentially generated as difference coefficient data DD in accordance with updating of the order data n of a frame designated by the frame designating data FNO.

The interpolating difference coefficient generating circuit 27 may comprise the difference coefficient generating circuit 22 of FIG. 10. In this case, the difference coefficient memory 22A (FIG. 10) is replaced with an interpolating difference coefficient memory for storing the interpolating difference coefficient data shown in FIG. 6.

The interpolating difference coefficient memory and the order memory in the interpolating difference coefficient generating circuit 27 do not have memory areas for storing interpolating difference coefficient and order number data representing order number thereof when the difference between the current frame and the immediately preceding frame is zero.

The difference coefficient data DD generated from the interpolating difference coefficient generating circuit 27 is supplied to an accumulator 43 through a gate circuit 42. In the second embodiment, a control signal S12 is supplied from an AND gate 47 to the enable terminal of the gate circuit 42. The AND gate 47 generates the control signal S12 of logic "1" when it receives a differentiated output S13 of logic "1" from a differentiating circuit 48 (operated in response to a timing signal $t_X$) during one calculation interval $T_{tX}$ under a condition wherein an inverted output $\overline{FD}$ from an inverter 41 is set at logic "1" (i.e., the last frame is not initiated). In response to the signal S12 of logic "1", the gate circuit 42 is enabled. Every time one period of the musical tone waveshape has elapsed, the first to 64th difference coefficient data DD are supplied to the accumulator 43 through the gate circuit 42.

An adder 44 sequentially adds the difference coefficient data DD supplied through the gate circuit 42 to a one-period preceding sum output S1l stored in a shift register 46. The accumulator 43 sequentially accumulates the difference coefficient data DD supplied from the interpolating difference coefficient generating circuit 27 for each period of the musical tone waveshape in units of orders.

The accumulation data appears from the output terminal of the gate circuit 45 and is supplied as difference accumulation coefficient data DS to an adder 25. The adder 25 adds the basic coefficient data RD with the difference accumulation coefficient data DS of each order. A sum is supplied as harmonic coefficient output data S2 for a harmonic coefficient generating circuit 7 to a multiplier 11.

With the arrangement of FIG. 12, when a key is depressed, a repetition number counter 32 and a frame counter 37 are reset in response to a key-on pulse signal KONP obtained through a differentiating circuit 10. The frame designating data FNO designates the first frame F1, and repetition number count data CV is set to be 0.

In this case, since the data CV is 0 and the frame designating data FNO is set to be 1, a gate control circuit 49 of the accumulator 43 of the harmonic coefficient generating circuit 7 disables the gate circuit 45 through an inverter 50. Therefore, the accumulator 43 does not generate the difference accumulation coefficient data DS, and the contents of the respective stages of a shift register 46 are cleared.

Upon depression of the key, only the basic coefficient data RD is supplied from the basic coefficient memory 21 to the adder 25 of a forming circuit 24 and this is supplied as the harmonic coefficient data S2 to the multiplier 11.

In the same manner as in FIG. 1, the multiplier 11 generates the output S3 obtained by multiplying the harmonic coefficient data S2 of the first to 64th order basic coefficient data RD (FIG. 3A) with the sampling point amplitude values of the first to 64th order harmonic components of the first period of the musical tone waveshape generated from a sinusoid table 4.

When the accumulator completes the accumulation of one period of the musical tone waveshape and generates a carry signal CA, the AND gate 47 generates the output S12 of logic "1" for one calculation interval $T_{tX}$, thereby enabling the gate circuit 42. Upon generation of the carry signal CA, the repetition number counter 32 is started to change the repetition number count data CV from 0 to 1. In this case, the gate control circuit 49 is operated to change the output S14 to logic "0", and then the gate circuit 45 is enabled. The difference coefficient data DD from the interpolating difference coefficient generating circuit 27 is supplied as the difference accumulation coefficient data DS through the gate circuit 42, the adder 44 and the gate circuit 45. In this case, the content of the frame designating data FNO supplied to the interpolating difference coefficient generating circuit 27 is 1, so that the first to 64th order interpolating difference data $(Q2-Q1)/K_1$ corresponding to the first frame F1 are sequentially read out from the circuit 27.

Basically, the basic coefficient data RD from the basic coefficient memory 21 and the difference accumulation coefficient data DS are supplied to the adder 25 in the forming circuit 24. A sum is supplied as the harmonic coefficient data S2 to the multiplier 11. At the same time, the sinusoid data S1 of the first to 64th order harmonic components of the second period of the waveshape are generated from the sinusoid table 4. The multiplier 11 multiplies the sinusoid data S1 with the harmonic coefficient data S2 which is changed to reach the harmonic coefficient data Q2 (FIG. 3B) by one step $(Q2-Q1)/K_1$.

Figure 13:
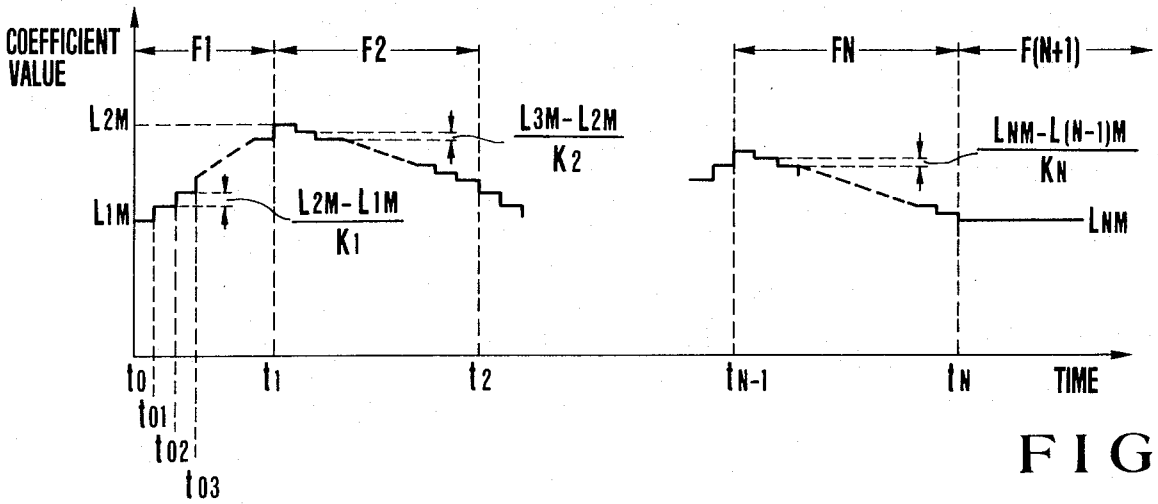
FIG. 13 is a timing chart of Mth harmonic coefficient data of FIG. 12.

For example, as shown in FIG. 13, at the time $t_{01}$ when the first period of the musical tone signal is completed, the content of the Mth harmonic coefficient data S2 is updated from $L_{1M}$ by $(L_{2M}-L_{1M})/K_1(=\Delta SP_{2M}/K_1)$.

In the same manner as described above, every time one period of the musical tone signal is completed, the accumulator 3 supplies the carry signal CA to the repetition number counter 32. The value of the repetition number count data CV is incremented one by one. However, the frame designating data FNO from the frame counter 37 does not change. Therefore, the interpolating difference coefficient generating circuit 27 continuously generates the difference coefficient data $DD=(Q2-Q1)/K_1$ of the first frame F1.

However, when the gate circuit 42 generates the carry signal CA, the gate circuit 42 is enabled in response to the output S12 from the AND gate 47 for one period $T_{tX}$ of the calculation interval timing signal $t_X$. Therefore, the first to 64th order difference coefficient data DD are supplied once from the interpolating difference coefficient generating circuit 27 to the accumulator 43. In this case, every time the accumulator 43 receives the data DD, the data DD is added to the data sequentially generated from the shift register 46. The accumulator 43 then generates the resultant sum as the difference accumulation coefficient data DS. At the same time, the sum is cyclically stored by a loop consisting of the shift register 46, the adder 44, the gate circuit 45 and the shift register 46.

Every time the accumulator 43 completes the accumulation of one period of the musical tone waveshape, the accumulator 43 accumulates the difference coefficient data DD generated from the interpolating difference coefficient generating circuit 27.

In the first frame F1, as shown in FIG. 13, the difference accumulation coefficient data DS for the Mth order harmonic coefficient is incremented by one step by the interpolating difference data $(L_{2M}-L_{1M})/K_1$ $(=\Delta SP_{2M}/K_1)$ for each times $t_{02}$, $t_{03}$, . . .

The sequentially incremented difference accumulation coefficient data DS is added by the adder 25 to the basic coefficient data RD, and the adder 25 generates the harmonic coefficient data S2. As a result, the tone color of the musical tone generated from the sound system 9 during the first frame is continuously changed in practice.

When the count of the repetition number counter 32 coincides with the repetition number K $(=K_1)$ designated by the repetition number designating circuit 34, the harmonic coefficient generating circuit 7 stops generating the coefficients of the first frame F1, thereby initiating the second frame F2.

When the frame designation data FNO is changed to 2, the interpolating difference coefficient generating circuit 27 is controlled to generate the interpolating difference coefficient $(Q3-Q2)/K_2$ set as the coefficient data DD for the second frame F2. In this case, every time the accumulator 3 generates the carry signal CA, the gate circuit 42 is enabled for one period $T_{tX}$ of the calculation interval timing signal $t_X$, thereby supplying new difference coefficient data DD to the accumulator 43. Therefore, when the second frame F2 is initiated, the accumulator 43 further adds the difference coefficient data DD to the accumulation result of the first frame.

As shown in FIG. 13, the Mth order harmonic coefficient data S2 is updated by the interpolating difference coefficient data $(L_{3M}-L_{2M})/K_2$ every time one period of the musical tone waveform is ended from the time $t_1$ of the frame F2. In the case of FIG. 4B, since the difference data $L_{3M}-L_{2M}$ is negative, the difference accumulation coefficient data DS is decremented one by one from the accumulation result of the first frame by the difference coefficient data DD.

The above operation is continued until the repetition number count data of the repetition number counter 32 coincides with the value $K_2$ since the content of the repetition number designating data K of the repetition number designating circuit 34 is updated to the value $K_2$ of the second frame F2. Therefore, the values of the harmonic coefficient data S2 of the respective orders of the second frame from the harmonic coefficient generating circuit 7 are updated in a stepped manner but different from the manner of the first frame F1. As a result, the tone color of the musical tone generated from the sound system 9 for the second frame differs from that of the first frame.

The above operation is repeated for the third to Nth frames F3 to FN. When the Nth frame FN is ended at the time $t_N$ of FIG. 2, the time $t_N$ is detected by a last frame detector 40. The content of the frame designating data FNO is not updated but maintained.

In this case, the interpolating difference coefficient generating circuit 27 generates 0 as the difference coefficient data DD (DD=0), and the gate 42 is disabled. The accumulator 43 will not substantially perform accumulation. As a result, the accumulation result of the Nth frame is maintained during the (N+1)th frame.

As shown in FIG. 13, for example, the value $L_{NM}$ obtained by the accumulator 43 for accumulating the last interpolating difference data $(L_{NM}-L_{(N-1)M})/K_N$ during the Nth frame FN is maintained in the (N+1) frame after the time $t_N$.

As a result, the tone color of the musical tone generated from the sound system 9 is maintained until the depressed key is released.

With the arrangement shown in FIG. 12, the amplitudes of the respective harmonic components included in the musical tone signal vary in respective frames. At the same time, the amplitude within the same frame is continuously changed. Musical tones most similar to a natural musical instrument can be generated from the sound system 9. The basic coefficient memory 21 must store only one set of the first to 64th order basic harmonic coefficient data Q1 (FIG. 4A). Other storage data comprises a set of interpolating difference data which have a small amplitude change throughout the frames and which are stored in the interpolating difference coefficient generating circuit 27. As a result, the memory capacity of the harmonic coefficient generating circuit 7 as a whole can be decreased.

Furthermore, no memory areas are assigned to the interpolating difference data when the difference between each adjacent frames is zero. Therefore, the memory capacity of the interpolating difference coefficient memory can be decreased.

THIRD EMBODIMENT

Figure 14:
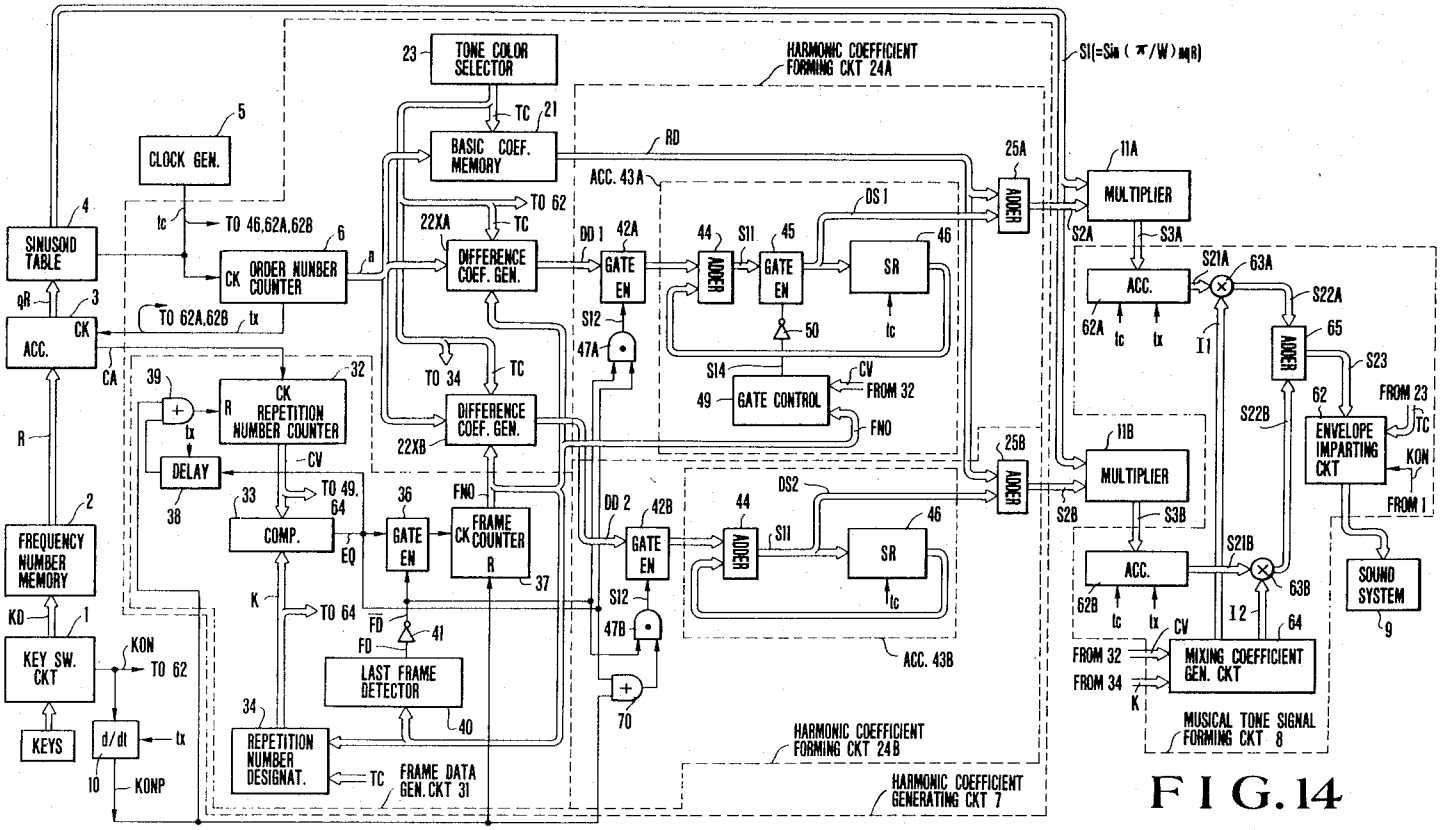
FIG. 14 is a block diagram of a musical tone signal generating apparatus according to the third embodiment of the present invention.

FIG. 14 shows still another embodiment of the present invention. A rapid change in updating of the difference coefficients is prevented on the basis of the arrangement of FIG. 1.

In this embodiment, two series of difference coefficient generating circuits 22, forming circuits 24, multipliers 11 and musical tone signal forming circuits 8 are prepared. The first series of components is used to process the harmonic coefficient data of the current frame, and the second series of components is used to process the harmonic coefficient data of the next frame. The weighting coefficients of the first and second series harmonic coefficient data are changed to opposite polarities. As a result, the harmonic coefficient data generated from a harmonic coefficient generating circuit 7 is switched from the harmonic coefficient data of the current frame to that of the next frame during one frame interval.

Referring to FIG. 14, the harmonic coefficient generating circuit 7 has first and second series difference coefficient generating circuits 22XA and 22XB corresponding to the difference coefficient generating circuit 22 of FIG. 1. The first series difference coefficient generating circuit 22XA stores the difference coefficient data (FIG. 7) of the current frame which have the same content as in FIG. 5. More specifically, the circuit 22XA stores the difference data (Q2−Q1), (Q3−Q2), .

. . (QN−Q(N−1)) (FIG. 4A, . . . ) of the second frame F2, the third frame F3, . . . the Nth frame FN. The first series difference coefficient generating circuit 22XA does not have a memory area for the first frame F1 and the (N+1)th frame F(N+1).

The second series difference coefficient generating circuit 22XB stores the coefficient data of the frame next to the current frame. More specifically, the circuit 22XB stores the difference coefficient data (Q2−Q1), (Q3−Q2), . . . (QN−Q(N−1)) (FIG. 4A, . . . ) of the first frame F1, the second frame F2, . . . the (N−1)th frame. The second series difference coefficient generating circuit 22XB does not have memory areas for the Nth frame FN and the (N+1)th frame (N+1).

The first and second series difference coefficient generating circuits 22XA and 22XB store the difference coefficient data having orders whose harmonic coefficient values are changed throughout the frames F1 to FN in the same manner as in the embodiment of FIG. 1. However, when the harmonic coefficient values are not changed for each two adjacent frames, the difference coefficient data is not stored. The memory capacity of the difference coefficient memories 22A (FIG. 10) in the difference coefficient generating circuits 22XA and 22XB can be decreased in the same manner as in FIG. 1.

The first and second series difference coefficient generating circuits 22XA and 22XB generate the difference coefficient data DDl and DD2 throughout the frames F1 to FN designated by the frame designating data FNO during time slots in accordance with the order data n. The difference coefficient data DDl of the current frame is supplied to a first series accumulator 43A through a gate circuit 42A, and at the same time the difference coefficient data DD2 of the next frame is supplied to a second series accumulator 43B through a gate circuit 42B.

The difference accumulation coefficient data DS1 and DS2 in the accumulators 43A and 43B are added by adders 25A and 25B to the basic coefficient data RD read out from a basic coefficient memory 21. The harmonic coefficient data S2A and S2B appearing at output terminals of the adders 25A and 25B are multiplied by first and second series multipliers 11A and 11B with the sinusoid data S1.

First series multiplied output data S3A representing the harmonic component of the current frame appears at the output terminal of the multiplier 11A and is supplied to a first series accumulator 62A in a musical tone signal forming circuit 8. Second series multiplied output data S3B representing the harmonic component of the next frame appears at the output terminal of the multiplier llB and is supplied to a second series accumulator 62B in the musical tone signal forming circuit 8.

The accumulators 62A and 62B accumulate the corresponding harmonic components for each calculation interval $T_{tX}$. The amplitude data S21A and S21B representing the amplitude values of the sampling points of the musical tone waveshape are generated from the accumulators 62A and 62B and are supplied as first multiplying inputs to first and second series mixing circuits 63A and 63B each having a multiplier. Mixing coefficient data $I_1$ and $I_2$ are supplied from a mixing coefficient generating circuit 64 to the mixing circuits 63A and 63B and are multiplied with the musical tone waveshape amplitude data S21A and S21B, respectively.

Figure 15:
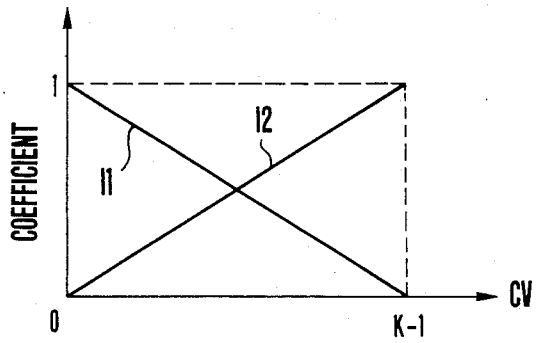
FIGS. 15 to 17 are respectively graphs showing mixing coefficient data of a mixing coefficient generating circuit of FIG. 14.

The mixing coefficient generating circuit 64 receives repetition number count data CV from a repetition number counter 32 and repetition number designating data K of a repetition number designating circuit 34. As shown in FIG. 15, the mixing coefficient data $I_1$ and $I_2$ which are linearly decreased with an increase of the repetition number count data CV are generated as follows:

$$I_1 = 1 - CV/(K-1) \quad (3)$$

$$I_2 = CV/(K-1) \quad (4)$$

The mixing coefficient data $I_1$ is 1 when the repetition number count data CV is 0. However, under the same condition, the mixing coefficient data $I_2$ is 0. When the repetition number count data CV is increased one by one, the mixing coefficient data $I_1$ is decreased by 1/(K−1) and the mixing coefficient data $I_2$ is increased by 1/(K−1). When the repetition number count data CV has reached (K−1), the mixing coefficient data $I_1$ becomes 0, while the mixing coefficient data $I_2$ becomes 1.

The outputs S22A and S22B from the mixing circuits 63A and 63B are supplied to an adder 65. A sum output from the adder 65 is supplied to an envelope imparting circuit 62. The output S22B component included in the sum output S23 is 0 when the mixing coefficient data $I_2$ is 0 since the repetition number count data CV is 0. However, the output S22A component has a maximum value since the mixing coefficient data $I_1$ is 1. Therefore, the sum output S23 represents the content of the output S22A at the beginning of each frame.

When the repetition number count data CV is increased, the ratio of the output S22B to the output S22A is gradually increased.

When the repetition number count data CV has reached (K−1), the mixing coefficient data $I_1$ becomes 0, so that the output S22A component becomes 0. At the same time, since the mixing coefficient data $I_2$ is 1, the output S22B component takes a maximum value.

The content of the sum output S23 is updated from the musical tone signal based on the amplitude data S21A to the musical tone signal based on the amplitude data S21B when the repetition number count data CV is increased. In other words, the tone color based on the harmonic coefficient data S2A generated from the adder 25A is gradually updated to the tone color based on the harmonic coefficient data S2B generated from the adder 25B.

A musical tone signal of changing tone color is converted to a musical tone when the tone signal is supplied from the envelope imparting circuit 62 to the sound system 9.

With the arrangement of FIG. 14, when a key is depressed, the repetition number counter 32 and the frame counter 37 are reset in response to the key-on pulse signal KONP supplied through a differentiating circuit 10. The frame designating data FNO represents the first frame F1, and the repetition number count data CV is 0.

The accumulator 43A is controlled by a gate control circuit 49, but the accumulator 43B simply supplies the data to the accumulator 43B since no gate control circuit is provided for the accumulator 43B. Furthermore, an OR gate 70 is connected to the input terminal of the gate circuit 42B which receives the coincidence detection output EQ from a control AND gate 47B. The key-on pulse signal KONP is supplied through the OR gate 70, thereby enabling the gate circuit 42B upon operation of the key.

The difference coefficient data DD2 generated from the difference coefficient generating circuit 22XB is supplied to the accumulator 43B through the gate circuit 42B. Only the basic coefficient data RD from the basic coefficient memory 21 is supplied to the adder 25A for the first one calculation interval $T_{tX}$ of the first frame. However, the adder 25B receives the basic coefficient data RD and the difference accumulation coefficient data DS2 generated from the accumulator 43B. The adder 25B generates the harmonic coefficient data S2B corresponding to the harmonic coefficient data Q2 as a sum of the harmonic coefficient data Q1 of the first frame F1 and the difference coefficient data (Q2−Q1) to be added for the second frame F2.

The content of the harmonic coefficient data S2B is that generated in the frame (i.e., the second frame F2) next to the current frame (i.e., the first frame F1).

The harmonic coefficient data S2A of the first frame F1 is supplied to the multiplier 11A, while the harmonic coefficient data S2B of the next frame, i.e., the second frame F2 is supplied to the multiplier llB. The musical tone waveshape amplitude data S21A of the first frame appears at the output terminal of the accumulator 62A. The musical tone waveshape amplitude data S21B of the second frame F2 appears at the output terminal of the accumulator 62B.

When the repetition number count data CV is incremented one by one every time the accumulator 3 generates the carry signal CA, the mixing coefficient data $I_1$ and $I_2$ generated from the mixing coefficient generating circuit 64 are inversely proportionally changed, as described with reference to FIG. 15. The content of the musical tone signal S23 appearing at the output terminal of the adder 65 is gradually updated such that the ratio of the musical tone waveshape amplitude data of the first frame F1 to that of the second frame F2 is gradually changed.

When the coincidence detection output EQ is generated from the comparator 33, the gate circuits 42A and 42B are enabled for one calculation interval $T_{tX}$. The difference coefficient data DD1 (i.e., (Q2−Q1)) of the second frame F2 is supplied to the accumulator 43A and is added as the difference accumulation coefficient data DS1 by the adder 25A to the basic coefficient data RD.

The difference coefficient data DD2 of the third frame F3 is supplied to the accumulator 43B and is added to the data accumulated during the first frame F1. The resultant difference accumulation coefficient data DS2 is a sum of the difference coefficient data (Q2−Q1) and (Q3−Q2). Therefore, the harmonic coefficient data S2B having the same content as that of the harmonic coefficient data Q3 obtained during the third frame F3 can be obtained from the adder 25B.

When the second frame F2 is initiated, the harmonic coefficient data Q2 obtained for the second frame F2 and the harmonic coefficient data Q3 obtained for the third frame F3 are supplied to the multipliers 11A and 11B, respectively.

The mixing coefficient generating circuit 64 receives the predetermined repetition number designating data K (=$K_2$) of the second frame F2 and generates the mixing coefficient data $I_1$ and $I_2$ which are inversely proportionally changed on the basis of the data K. The musical tone signal S23 having harmonic components which are continuously changed from the harmonic coefficient data Q2 of the second frame F2 to that of the harmonic coefficient data Q3 of the third frame F3 can appear at the output terminal of the adder 65.

In the same manner as described above, the musical tone signals S23 having harmonic components which are continuously changed from the current frame to the next frame up to the Nth frame FN sequentially appear at the output terminal of the adder 65.

In the (N+1)th frame F(N+1), the difference coefficient data DDl and DD2 are not supplied to the accumulators 43A and 43B, respectively. The accumulators 43A and 43B will not perform further accumulations. The content of the harmonic coefficient data S2A obtained from the adder 25A is the same as that of the harmonic coefficient data S2B obtained from the adder 25B. The tone color of the musical tone signal S2 appearing at the output terminal of the adder 65 will not change.

With the arrangement shown in FIG. 14, for example, the Mth order harmonic coefficient data S2 substantially included in the musical tone signal S23 from the adder 65 is continuously changed from the value $L_{1M}$ at the start time $t_0$ to the value $L_{2M}$ at the end time $t_1$ in the first frame F1, as shown in FIG. 11F in correspondence with FIG. 11E. The Mth order data S2 is then changed from the value $L_{2M}$ at the start time $t_1$ of the second frame F2 to the value $L_{3M}$ at the end time $t_2$ thereof. Subsequently, the Mth order data S2 is changed to the value $L_{(N-1)M}$ at the start time $t_{N-1}$ of the Nth frame FM to the value $L_{NM}$ at the end time $t_N$ thereof. The value $L_{NM}$ at the time $t_N$ is maintained during the (N+1)th frame F(N+1).

With the arrangement of FIG. 14, a musical tone signal generating apparatus can be obtained wherein the harmonic coefficient data of each frame is continuously changed to continuously change the tone color of the musical tone. The difference coefficient data stored in the difference coefficient generating circuits 22XA and 22XB comprise only data of the orders whose amplitudes between each two adjacent frames are changed. Therefore, the memory capacity can be decreased.

Figure 16:
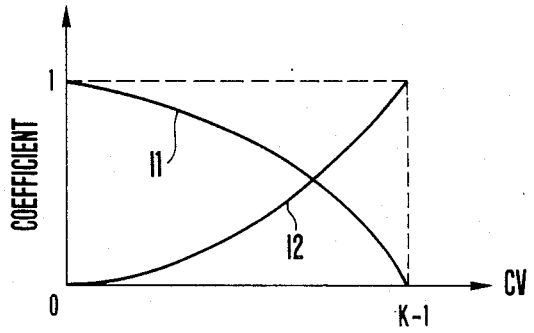
Figure 17:
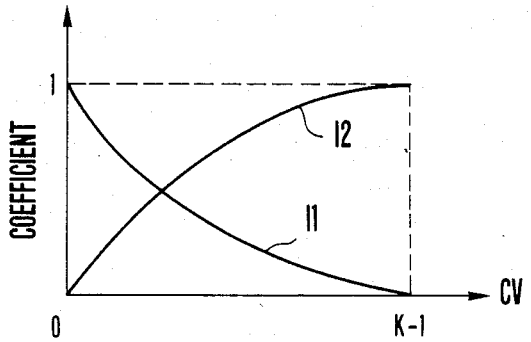

In the embodiment of FIG. 14, the mixing coefficient data $I_1$ and $I_2$ generated from the mixing coefficient generating circuit 64 are linearly changed. However, as shown in FIGS. 16 and 17, the mixing coefficient data may be nonlinearly changed to obtain the same effect as described above.

In the embodiment of FIG. 14, the mixing circuits 63A and 63B are inserted at the output sides of the accumulators 62A and 62B in the musical tone signal forming circuit 3. However, the circuits 63A and 63B may be inserted at the input or output sides of the adders 25A and 25B.

In this case, the first and second series harmonic coefficient data S2A and S2B weighted with the mixing coefficient data $I_1$ and $I_2$ are added. The resultant harmonic coefficient data S2 (=S2A+S2B) is supplied to the multiplier 11 of FIG. 1. With this arrangement, the two accumulators need not be used in each of the multiplier and the musical tone signal forming circuit. Only one accumulator can be used in each of the multiplier and the musical tone signal forming circuit.

In the embodiment of FIG. 14, the mixing coefficient generating circuit 64 generates the mixing coefficient data $I_1$ and $I_2$ by calculations. However, as shown in FIGS. 15 to 17, the data representing the characteristic curves can be stored in, for example, a ROM. In this case, the ROM is accessed in response to the repetition number designating data K and the repetition number count data CV.

In the embodiment of FIG. 14, two series of signal processing circuits are provided when the mixing coefficient data $I_1$ and $I_2$ are weighted by the independent mixing circuits and are combined. Instead, the data of the two series systems can be time-serially, time-divisionally processed. In this case, only one system for processing the data can be used. In this case, a single difference coefficient generating circuit corresponding to the difference coefficient generating circuits 22XA and 22XB is arranged. The difference coefficient data and their order data of each two adjacent frames are read out from the the difference coefficient memory and the order memory (FIG. 10) in the difference coefficient generating circuit to obtain the second series difference coefficient data DDl and DD2.

FOURTH EMBODIMENT

In the above embodiments, when no difference occurs between the data of each two adjacent frames, no difference data having zero value is stored in the difference coefficient memory, thereby considerably decreasing the memory capacity. However, even if zero data is stored in the difference coefficient memory, the memory capacity can be decreased by memorizing data in the form of difference. With this arrangement, referring to FIG. 10, the selector 22B, the comparator 22D, and the order memory 22C can be omitted. The output from the order number counter 6 is supplied together with the signals TC and the FNO to the difference coefficient memory 22A to read out the difference coefficient data therefrom in order of order number corresponding thereto.

FIFTH EMBODIMENT

Figure 18:
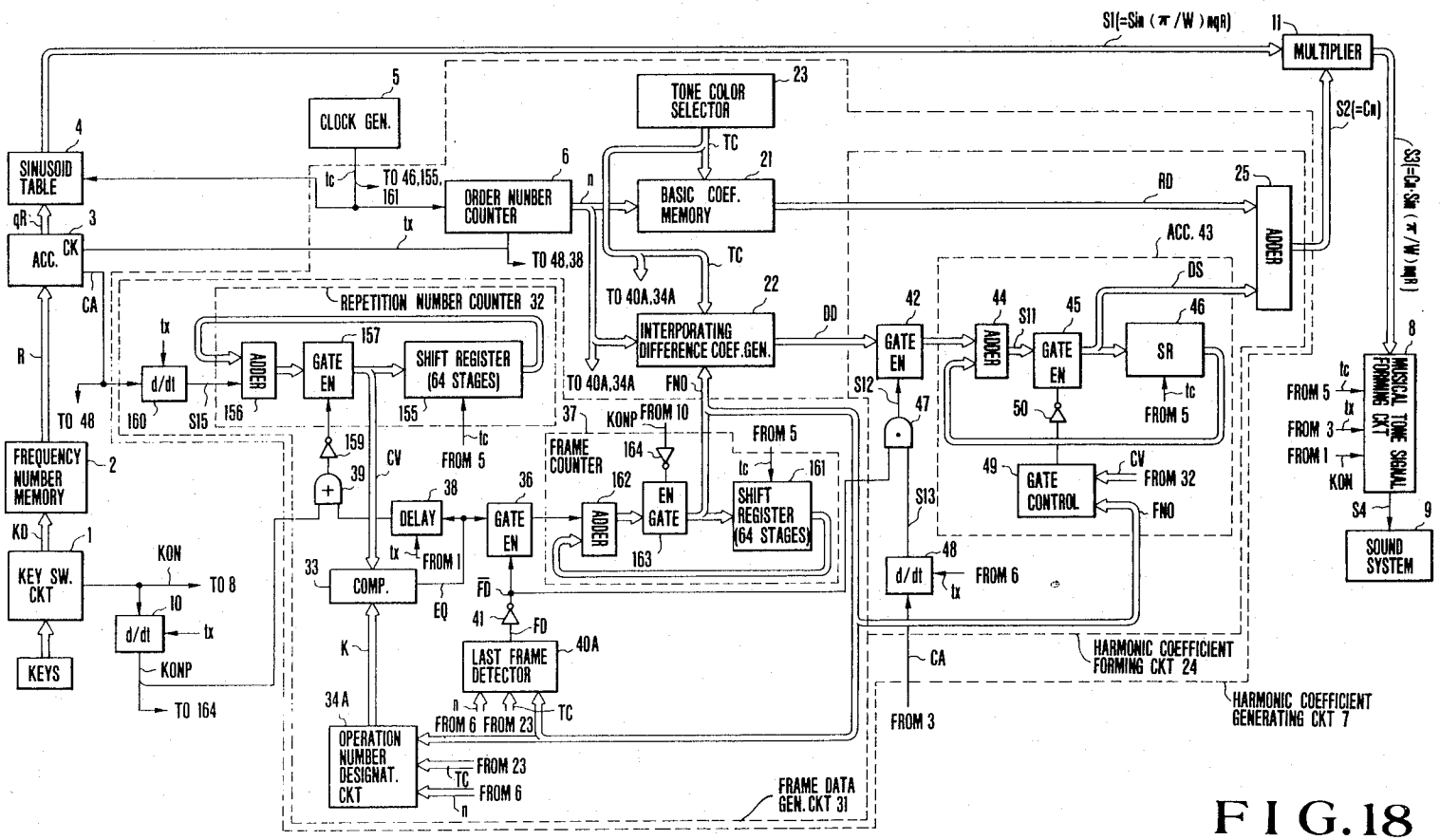
FIG. 18 is a block diagram of a musical tone signal generating apparatus according to a fifth embodiment of the present invention.

FIG. 18 shows a fifth embodiment of the present invention, wherein the frame number and the repetition number of each frame can be preset for each order. For an order whose harmonic coefficient changes in a complex manner, the time interval of the musical tone signal from the beginning to the end is divided into a large number of frames, so that a frame length can be shortened. However, for an order whose harmonic coefficient changes only slightly, the time interval of the musical tone signal from the beinging to the end is divided into a small number of frames, thereby increasing a frame length.

In this embodiment, changes in harmonic coefficients are set to differentiate the interpolating difference data of the respective frames from each other by determining different repetition numbers $K_1$ to $K_N$ for each order.

The same reference numerals as in FIG. 12 denote the same parts in FIG. 18. A repetition number counter 32 has a 64-stage shift register 155. The shift register 155 is operated in response to a clock signal $t_C$ and generates the input data by delaying one-period time $T_{tX}$ of the calculation interval timing signal $t_X$. An output from the shift register 155 is added by an adder 156 to a "+1" sum input S15. A sum is fed back to the input terminal of the shift register 155 through a gate circuit 157. The data obtained by adding the first to 64th repetition number data (generated from the shift register 155) to "+1" is supplied to the input terminal of the shift register 155. The input data to the shift register 155 is supplied as repetition number count data CV to a comparator 133. A differentiating circuit 160 differentiates the carry signal CA, and a "+1" sum input S15 is generated as a signal of logic "1" from the differentiating circuit 160 during one period $T_{tX}$ of the timing signal $t_X$.

The repetition number designating circuit 34A stores the repetition number designating data corresponding to the first to 64th harmonics. The repetition number data is fed out in response to the order data n from an order number counter 6.

The comparator 133 compares the repetition number count data CV with the repetition number designating data K during the time slots respectively corresponding to the first to 64th harmonic coefficient data.

The comparator 133 generates a coincidence detection output EQ for each time slot of the corresponding harmonic coefficient data. The coincidence signal is delayed by a delay circuit 38 by one period time $T_{tX}$ of the calculation interval timing signal $t_X$. The delayed signal is supplied to an inverter 159 through an OR gate 39. An output from the inverter 159 is supplied to the enable terminal of a gate circuit 157. During the time slot for providing the coincidence detection output EQ, the gate circuit 157 is disabled. As a result, the order data corresponding to this time slot and stored in the shift register 155 is reset to zero.

Furthermore, a key-on pulse signal KONP is supplied to the enable terminal of the gate circuit 157 through the OR gate 39 and the inverter 159. When any of the keys is depressed, the gate circuit 157 is disabled for the one period interval $T_{tX}$ of the calculation interval timing signal $t_X$, and the contents of all the stages of the shift register 155 are reset to 0.

In the same manner as in the repetition number counter 32, the frame counter 37 has a shift register 161, a "+1" adder 162 and a gate circuit 163. A coincidence detection output EQ from the comparator 33 is supplied as a "+1" sum input to the circuit 162 through the gate circuit 136. The key-on pulse signal KONP is inverted by an inverter 164, and an inverted signal is supplied to the enable terminal of the gate circuit 163. When any one of the keys is depressed, the gate circuit 163 is disabled for one period $T_{tx}$ of the calculation interval timing signal $t_X$, thereby clearing all the first to 64th order frame designating data FNO from the shift register 161. Thereafter, every time the comparator 133 generates the coincidence detection signal EQ, the adder 162 adds the data appearing at the output terminal of the shift register 161 to the numerical data "+1".

Since the comparator 133 generates the coincidence detection signal EQ for the respective time slots corresponding to the first to 64th orders, the contents of the first to 64th frame designating data FNO in the shift register 161 are updated independently in units of orders. Therefore, the interpolating difference coefficient data DD read out from the interpolating difference coefficient memory 22 are associated with the different frames in units of frames.

A last frame detector 40A detects last frame data stored for each order in response to the order data n generated from the order number counter 6 and the frame designation data FNO during the corresponding time slots. As a result, during the last frame time slot for the frame designating data FNO, when the last frame detection signal FD is obtained, the gate circuit 136 is disabled for this time slot. Therefore, "+1" is not added to the frame designating data FNO of the order corresponding to this time slot.

With the above arrangement, when any one of the keys is depressed, the gate circuit 157 of the repetition number counter 32 and the gate circuit 163 of the frame counter 37 are disabled in response to the key-on pulse signal KONP. Every time the accumulator 3 generates a carry signal CA, the repetition number counter 32 performs addition of the data corresponding to the respective orders of the shift register 155 in response to the "+1" input S15 supplied for one period $T_{tX}$ of the calculation interval timing signal $t_X$ supplied from the differentiating circuit 160. The content of the repetition number count data CV is incremented one by one for each period of the musical tone waveshape.

When the gate circuit 163 in the frame counter 37 is disabled in response to the key-on pulse signal KONP, all the contents of the stages of the shift register 161 are cleared. Therefore, the frame counter 37 repeatedly supplies the frame designating data FNO representing the first frame F1 to the repetition number designating circuit 34.

In this case, the repetition number designating circuit 34 supplies to the comparator 133 the repetition number designating data K read out from the order data n designated for each time slot. The comparator 133 detects whether or not the repetition number preset for the first frame F1 coincides with the content of the repetition number counter 32 during each time slot. When the coincidence detection output EQ is generated in any one of the time slots, the coincidence detection output EQ is supplied as the "+1" sum data to the adder 162 in the frame counter 37, so that the numerical data "1" is added to the content which corresponds to the order during the time slot and which is stored in the shift register 161.

At the same time, the coincidence detection output EQ during the corresponding time slit is supplied to the gate circuit 157 through the delay circuit 38, the OR gate 139 and the inverter 159, so that all the contents of the shift register 155 are cleared. Therefore, the repetition number counter 32 is reset and starts counting the repetition number.

In the same manner as described above, when the coincidence detection signal EQ is obtained for every time slot corresponding to every order, the content of the register 161 of the frame counter 37 is incremented by one. At the same time, the repetition number data in the repetition number counter 32 is cleared to restart counting. Therefore, the content of the frame designating data FNO is incremented by one for each order. The repetition designating circuit 34 designates the second frame F2. At the same time, the repetition number counter 32 starts counting the repetition numbers of the respective orders during the second frame F2.

The above operation is repeated. When the frame designating data FNO is the last frame, this is detected by the last frame detector 40. The gate circuit 136 is disabled in response to the last frame detection signal FD, and the gate circuit 42 of the forming circuit 24 is disabled. The frame counter 37 will not perform a further "+1" addition. Simultaneously, the accumulator 43 will not start a further accumulation. Therefore, the difference accumulation coefficient data DS will not be updated and is generated.

Such an operation is performed for each order every time the content of the frame designating data FNO has reached the final frame. Thus, the generation of all the first to 64th order harmonic coefficient data S2 is completed.

With the arrangement of FIG. 18, the repetition numbers of the respective frames can be arbitrarily set. At the same time, the frame numbers are also independently determined independently of order number. Therefore, the tone color of the musical tone from the beginning to the end can be more similar to that of an acoustic musical instrument.

In an acoustic musical instrument, the higher order the harmonic component is, the faster it changes. Also, at the beginning of a musical tone, the amplitude of the higher order harmonic component tends to be large. In the arrangement of FIG. 18, the tone color can be easily changed when the harmonic components are changed from order to order.

SIXTH EMBODIMENT

Figure 19:
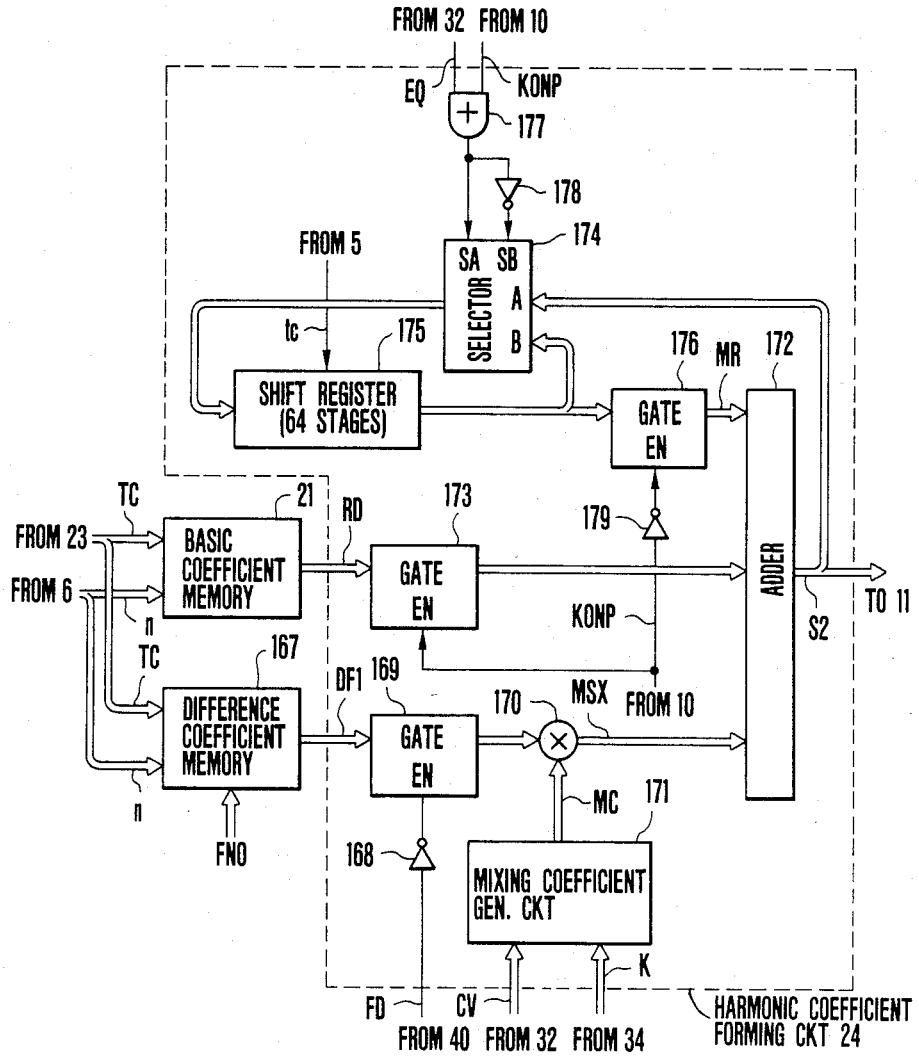
FIG. 19 is a block diagram showing a harmonic coefficient forming circuit in a musical tone signal generating apparatus according to a sixth embodiment of the present invention.

FIG. 19 shows a sixth embodiment. In the embodiments shown in FIGS. 12 and 18, the interpolating difference coefficients of the respective orders which are obtained by dividing the harmonic wave coefficient differences of each two adjacent frames by the corresponding repetition numbers are stored in the interpolating difference coefficient memory 22. However, in the case of FIG. 19, the harmonic coefficient differences of each two adjacent frames are directly stored in units of orders in a difference coefficient memory 167.

Difference coefficient data DF 1 read out from the difference coefficient memory 167 is supplied to a multiplier 170 through a gate circuit 169 for receiving a last frame detection signal FD at the enable terminal through a gate circuit 169. The multiplier 170 multiplies mixing coefficient data MC from a mixing coefficient generating circuit 171 with the data DFI and supplies a resultant signal to a first input of an adder 172.

Since repetition number count data CV is increased from 0 to K by CV/(K−1) for an end of each period of the musical tone waveshape during each frame, the mixing coefficient data MC (MC=CV/(K−1)) is increased from 0 to 1 accordingly. Difference coefficient data MSX appearing at the output terminal of the multiplier 170 is updated from 0 to the difference coefficient data DF1 during each frame.

Basic coefficient data RD from a basic coefficient memory 21 is supplied to the second input of the adder 172 through a gate circuit 173. The key-on pulse signal KONP is supplied to the enable terminal of the gate circuit 173. When any one of the keys is depressed, the gate circuit 173 is enabled for the one period time $T_{tX}$ of the first timing signal $t_X$, so that the basic coefficient data RD is supplied to the second input of the adder 172.

A sum output from the adder 172 is supplied as the harmonic coefficient data S2 to a multiplier 11. The harmonic coefficient data S2 is supplied to the A input terminal of a selector 174. A selected output from the selector 174 is supplied to a 64-stage shift register 175. The shift register 175 is operated in response to the clock signal $t_C$, so that the input data thereto is delayed by one period $T_{tX}$ of of the timing signal $t_X$. The delayed signal is supplied to the third input of the adder 172 and to the B input terminal of the selector 174.

The coincidence detection signal EQ as the A input selection signal and the key-on pulse signal KONP are supplied to the selector 174 through an OR gate 177. An output from the OR gate 177 is inverted by an inverter 178, and an inverted signal is supplied as the B input selection signal.

When any one of the keys is depressed, the selector 174 selects the harmonic coefficient data S2 (i.e., the basic coefficient data RD) which is then supplied to the shift register 175. Thereafter, an output from the shift register 175 is fed back to the input terminal of the shift register 175 through the selector 174, thereby storing the data cyclically. The harmonic coefficient data S2 is supplied to the shift register 175 through the selector 174 in response to the coincidence detection signal EQ generated upon end of each frame. Thereafter, this data is cyclically stored until the next coincidence detection signal EQ is generated.

The key-on pulse signal KONP is inverted by an inverter 179, and an inverted signal is supplied to the enable terminal of the gate circuit 176. The gate circuit 176 is disabled in response to the key-on pulse signal KONP.

With the arrangement of FIG. 19, when any one of the keys is depressed, the key-on pulse signal KONP is generated and the gate circuit 173 is enabled, so that the basic coefficient data RD is supplied from the basic coefficient memory 21 to the adder 172 for each time slot (i.e., each order). In this case, the gate circuit 176 is disabled in response to the key-on pulse signal KONP. The output from the shift register 175 will not be supplied to the adder 172. However, the difference coefficient data DF1 from the difference coefficient memory 167 is multiplied by the multiplier 170 with the mixing coefficient data MC supplied through the gate circuit 169, and the resultant data is supplied as the difference coefficient data MSX to the adder 172. However, at the beginning, the repetition number count data CV is set to be zero, so that the difference coefficient data MSX is also zero. The adder 172 generates the basic coefficient data RD as the harmonic coefficient data S2. In this state, the selector 174 selects the data at the B input terminal of the selector 174, i.e., the data MR at the output terminal of the shift register 175. The data MR is fed back to the input of the shift register 175. Therefore, the shift register 175 cyclically the basic coefficient data RD.

At the beginning, since the selector 174 selects the A input in response to the key-on pulse signal KONP, the harmonic coefficient data S2 are sequentially supplied to the shift register 175 through the selector 174.

When the leading edge of the key-on pulse signal KONP has elapsed, the gate circuit 173 is disabled, and the basic coefficient data RD is not supplied to the adder 172. At the same time, the gate circuit 176 is enabled through the inverter 179. The data MR in the shift register 175 is supplied to the adder 172 through the gate circuit 176. Therefore, the first to 64th order harmonic coefficient data S2 which are determined by the basic coefficient data RD are generated.

The data MR supplied from the shift register 175 to the adder 172 comprises the immediately preceding data by one calculation interval $T_{tX}$, that is, the basic coefficient data RD. The adder 172 can add the basic coefficient data RD to the difference coefficient data MSX. In this case, the number counter 132 is started to update the repetition number count data CV from 0 to 1. Accordingly, the value of the mixing coefficient data MC is updated to $1/(K-1)$, and the difference coefficient data MSX is increased by one step. The updated difference coefficient data MSX is added to the storage data MR (MR=RD). Therefore, the harmonic coefficient data S2 is changed to a degree wherein the difference coefficient data MSX is changed.

Every time one period of the musical tone waveshape has elapsed, the repetition number count data CV is incremented by one. Accordingly, the mixing coefficient data MC is incremented by one step, and the difference coefficient data MSX is changed by $1/(K-1)$. Therefore, the value of the harmonic coefficient data S2 is changed from that of the basic coefficient data RD (FIG. 3A) to the start value (FIG. 3B) of the second frame F2.

When the musical tone waveshape is generated by the repetition number $K_1$ of the first frame F1 and the comparator 133 generates the coincidence detection signal EQ, the selector 174 selects the A input in response to the coincidence detection signal EQ. The last harmonic coefficient data of the first frame F1 is fetched by the shift register 175. When the frame designating data FNO is incremented by one, the new difference coefficient data DF1 of the second frame F2 is read out from the difference coefficient memory 167. Therefore, the forming circuit 24 adds the difference coefficient data MSX obtained upon updating of the mixing coefficient data to the last harmonic coefficient data S2. The resultant harmonic coefficient data S2 is generated from the forming circuit 24.

In the same manner as described above, the calculations for the third to Nth frames F3 to FN are performed by the forming circuit 24, and the harmonic coefficient data continuously changing in accordance with interpolation operations can be obtained. Therefore, musical tones having a tone color change similar to that of an acoustic musical instrument can be produced.

In the mixing coefficient generating circuit 171 of FIG. 19, the mixing coefficient data MC is obtained in accordance with mathematical expression $CV/(K-1)$. This expression can be modified as needed.

In the mixing coefficient generating circuit 171, the mixing coefficient data may be stored in a mixing coefficient memory as a look-up table so as to form the mixing coefficient data MC. The storage data may be read out in response to the repetition number count data CV and the repetition number designating data K.

SEVENTH EMBODIMENT

Figure 20:
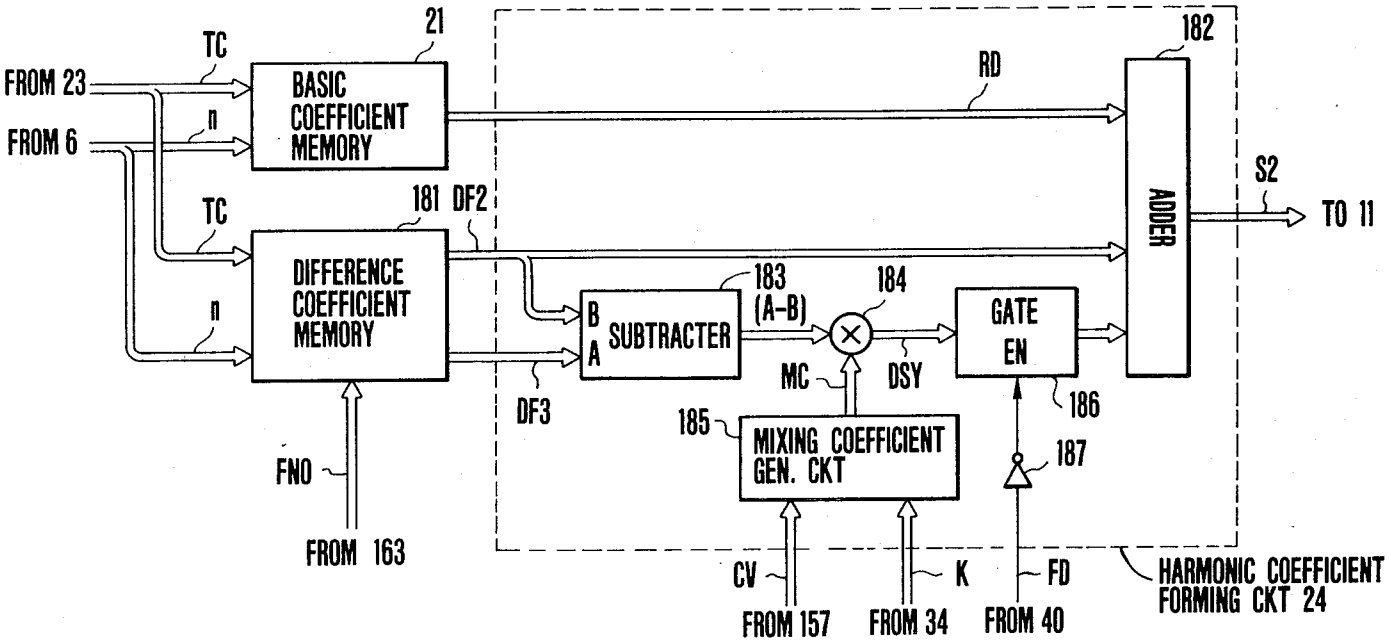
FIG. 20 is a block diagram showing a harmonic coefficient forming circuit in a musical tone signal generating apparatus according to a seventh embodiment of the present invention.

A forming circuit 24 may comprise that of FIG. 20. In this case, a difference coefficient memory 181 stores difference data of the first to Nth frames between the harmonic coefficients of the first to Nth frames F1 to FN and a predetermined basic coefficient. When one frame is designated by frame designating data FNO, the difference coefficient data DF2 of the corresponding frame and the difference coefficient data DF3 of a frame larger by one than the corresponding frame are simultaneously read out. The first difference coefficient data DF2 is directly supplied to a first input of an adder 182.

The first difference coefficient data DF2 is subtracted by a subtracter 183 from the second difference coefficient data DF3. A subtracted result is multiplied by a mixing coefficient generating circuit 185 with mixing coefficient data MC. The mixing coefficient generating circuit 185 can comprise the circuit 171 of FIG. 19. Therefore, a subtracted value (DF3−DF2) is multiplied with a mixing coefficient $CV/(K-1)$, and interpolating difference data DSY changed by one step upon increment of the repetition count data CV by one appears at the output terminal of a multiplier 184. The interpolating difference data DSY is supplied to the second input of the adder 182 through a gate circuit 186.

Since a last frame detection signal FD is inverted by an inverter 187 and an inverted signal is supplied as an enable signal to the gate circuit 186, the interpolating difference data DSY is not supplied to the adder 182 when the last frame is detected.

The adder 182 receives as a third input the basic coefficient data RD read out from a basic coefficient memory 21. A sum is generated as the harmonic coefficient data S2.

With the arrangement of FIG. 20, the subtracter 183 calculates the difference data (DF3−DF2) of the coefficient data DF2 of the current frame and the coefficient data DF3 of the next frame, thereby obtaining the range of the difference coefficients changing between each two adjacent frames. The mixing coefficient data MC changing by one step upon updating of the repetition number count data CV is multiplied with the changing range. Therefore, the interpolating difference data DSY representing a difference (i.e., a change) between the difference coefficient data DF2 and DF3 is obtained.

The interpolating difference data DSY is added by the adder 182 to the difference coefficient data DF2 and the basic coefficient data RD. The resultant harmonic coefficient data S2 of the current frame has a content which is continuously changed between the start value of the current frame and the start value of the next frame on the basis of the repetition coefficient K.

In this case, the gate circuit 186 is disabled in response to the last frame detection singal FD. When the last frame has elapsed, the harmonic coefficient data S2 determined by a sum of the difference coefficient data DF2 and the basic coefficient data RD is continuously generated.

With the arrangement of FIG. 20, the first to Nth harmonic coefficient data S2 which are changed at different rates of change throughout the frames can be obtained. In this case, the coefficient data memory means comprises only the basic coefficient memory 21 and the difference coefficient memory 181. In particular, small data can be stored as that stored in the difference coefficient memory 181, thereby decreasing the memory capacity.

Referring to FIG. 20, the output data of the respective frames which are generated from the subtracter 183 may be stored in the memory 181. In this case, the subtracter 183 can be omitted.

EIGHTH EMBODIMENT

Figure 21:
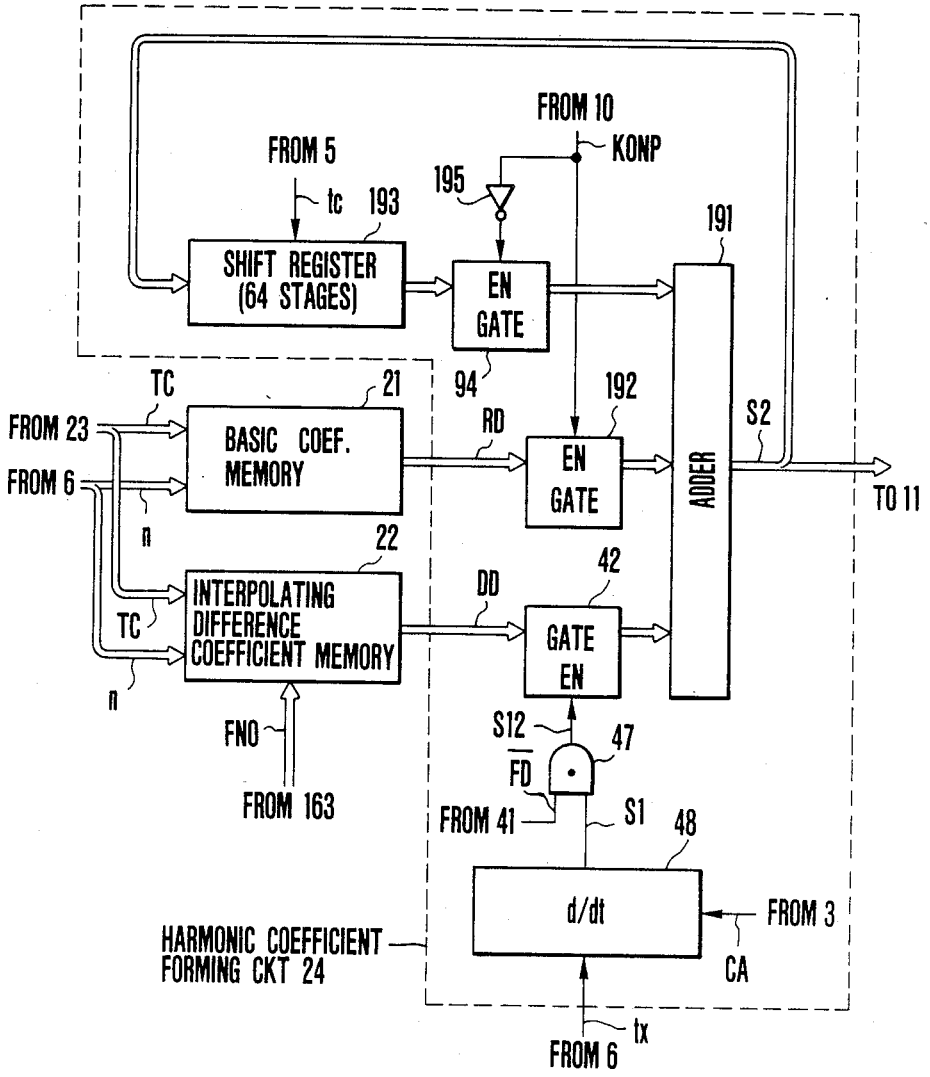
FIG. 21 is a block diagram showing a harmonic coefficient forming circuit in a musical tone signal generating apparatus according to an eighth embodiment of the present invention.

FIG. 21 shows another arrangement of the forming circuit 24 described above. Referring to FIG. 21, a memory comprises a basic coefficient memory 21 and an interpolating difference coefficient memory 22 in the same manner as in the embodiment of FIG. 12. Interpolating difference coefficient data DD is supplied as a first input of an adder 191 through a gate circuit 42 in the same manner as in FIG. 12.

Basic coefficient data RD from the basic coefficient memory 21 is supplied to the second input of the adder 191 through a gate circuit 192.

In this embodiment, harmonic coefficient data S2 appearing at the output terminal of the adder 191 is supplied to a 64-stage shift register 193. At the same time, an output from the shift register 193 is supplied to the third input of the adder 191 through a gate circuit 194.

A gate circuit 192 is enabled in response to the key-on pulse signal KONP to supply the basic coefficient data RD to the adder 191 for one calculation interval $T_{tX}$. The key-on pulse signal KONP is inverted by an inverter 195, and an inverted signal is supplied to a gate circuit 194. The gate circuit 194 is enabled for an interval excluding the leading edge of the key-on pulse signal KONP, thereby supplying the data from the shift register 193 to the adder 191.

With the arrangement of FIG. 21, when any one of the keys is depressed, the basic coefficient data RD is supplied from the basic coefficient memory 21 to the adder 191 in response to the key-on pulse signal KONP. The basic coefficient data RD is generated as the harmonic coefficient data S2 from the adder 191 and is also fetched by the shift register 193. When the key-on pulse signal KONP falls, the gate circuit 192 is disabled and the gate circuit 194 is enabled, thereby supplying the basic coefficient data RD from the shift register 193 to the adder 191. In this case, the adder 191 generates the input data as the harmonic coefficient data S2 supplied from the shift register 193, and the data S2 is fetched again by the shift register 193. Such an operation is repeated until one period of the musical tone waveshape has elapsed, i.e., until an accumulator 3 generates a carry signal CA.

When the carry signal CA is supplied to a differenting circuit 48, the gate circuit 42 is enabled through the AND circuit 47 for one calculation interval $T_{tX}$. The difference coefficient data DD of the first frame F1 which is read out from the interplating difference memory 22 is supplied to the adder 191 through the gate circuit 42. The basic coefficient data RD stored in the shift register 193 is added to the difference data DD of the first frame F1, and the resultant data is supplied as the haromic coefficient data S2 to the shift register 193. When one calculation interval $T_{tX}$ has passed, the gate circuit 42 is disabled, and the data fetched by the shift register 193 is cyclically stored in a loop of the gate circuit 194, the adder 191 and the shift register 193.

Every time one period of the musical tone waveshape of the first frame F1 has elapsed, the gate circuit 42 is enabled in response to the carry signal CA. The interpolating difference coefficient data DD is supplied from the interpolating difference memory 22 to the adder 191. The interpolating difference coefficient data DD is added to the data stored in the shift register 193. As a result, the content of the harmonic coefficient data S2 is changed by the interpolating difference coefficient data DD stored in the interpolating difference memory 22.

The comparator 33 generates the coincidence detection signal at the end of the first frame F1 to count up the frame counter 37. The interpolating difference coefficient data DD from the interpolating difference memory 22 is changed to the value for the second frame F2. The harmonic coefficient data S2 of the second frame F2 is calculated in accordance with the calculated value.

In the same manner as described above, when the frame counter 37 is operated to update the frame designating data FNO, the interpolating difference coefficient data DD generated from the interpolating difference coefficient memory 22 is updated to the harmonic coefficient data of the new frame. When the last frame is initiated, the last frame detector 39 detects the last frame, so that the gate circuit 42 is disabled. Therefore, the content of the harmonic coefficient data S2 appearing at the output terminal of the adder 191 corresponds to the data stored in the shift register 193. Thereafter, the harmonic coefficient data S2 calculated in the last frame is maintained.

With the arrangement of FIG. 21, the harmonic coefficient data S2 of the respective orders throughout the frames can be continuously changed in the same manner as in the above embodiments. Therefore, the memory stores only a set of basic harmonic coefficient data and a set of interpolating difference coefficient data of each frame. In particular, the values of the interpolating difference coefficient data are small, so that the total memory capacity can be decreased.

MODIFICATIONS

The present invention is not limited to the particular embodiments described above. Various changes and modifications may be made within the spirit and scope of the invention.

(1) Monophonic electronic musical instruments are respectively exemplified by the above embodiments. However, the present invention can be applied to a polyphonic electronic musical instrument. In this case, a plurality of sets of above-mentioned components for the respective tones are arranged in parallel with each other to simultaneously process the data. Alternatively, time-divisional processing can be formed for a plurality of tones.

(2) In each of the above embodiments, the basic coefficient data are stored in correspondence with all the orders (first to 64th orders) in the basic coefficient memory. However, when a musical tone signal having harmonic components of some of the orders is to be produced, the basic coefficient data are stored for the corresponding orders of the harmonic components in the musical tone production. In this case, a musical tone signal generating apparatus can be arranged by using a technique disclosed in the U.S. Pat. No. 4,256,004.

(3) In the above embodiments, the order data and the difference coefficient (the difference coefficient data or the interpolating coefficient data) of the respective harmonic components to be generated for each frame are stored in the difference coefficient generating circuit 22 (FIG. 1) and the difference coefficient generating circuits 22XA and 22XB (FIG. 14) and the interpolating difference coefficient generating circuit 27 (FIG. 12). However, the difference coefficient data can be expressed as a function of the order data. Such a function can be calculated by using the order data n, and the difference coefficient data of the respective orders can be generated. For example, the technique disclosed in U.S. Pat. No. 4,386,547 can be applied.

With this arrangement, the memory capacity of the difference coefficient data generating means can be further decreased.

(4) In the above embodiments, the harmonics of the respective orders are generated by using the frequency number R. However, another harmonic combining technique may be used. For example, instead of the frequency number, a note clock corresponding to the key may be counted by a counter to generate data corresponding to the accumulated output qR. The harmonic components to be combined can be generated in accordance with the resultant data.

(5) In the above embodiments, the frequencies of the respective harmonic components are set with an integer multiple to generate the harmonic musical tones. However, d in U.S. Pat. No. 3,888,153, frequencies of desired harmonic components are deviated from those given with an integer multiple (i.e., with a noninteger multiple), thereby generating a musical tone including non-harmonic components.

(6) In the above embodiments, frame updating is performed in units of periods of the musical tone waveshape. The frame interval is changed in accordance with the pitch of the depressed key. For example, the frame interval can be controlled irrespective of the period of the musical tone waveshape by arranging a timer circuit. In this case, a predetermined clock signal is supplied to the gate circuit 36 in the frame data generating circuit 31.

(7) In the above embodiments, the operation repetition number K to be performed during one frame is designated by the repetition number designating circuit 34, and the coefficient data of all the orders can be updated at an identical timing. However, the repetition number (or time) can be independently designated for the respective orders. When the coefficient data of the respective orders can be updated at the corresponding timings, the resultant musical tone has a tone color change more similar to that of an acoustic musical tone For this purpose, the frame data generating circuit 31 must comprise a frame data generating system including the repetition number counter 32, the repetition number designating circuit 34, the frame counter 37 and the last frame detector 40. A plurality of frame data generating systems corresponding to order numbers respectively are arranged in parallel with each other. Alternatively, the frame data generating system can be arranged to perform time-divisional processing.

(8) In the above embodiments, the shift register 46 is used to store the difference accumulation coefficient data in the accumulators 43, 43A and 43B. The shift register 155 (FIG. 18) is used to store the repetition number data in the repetition number counter 32, the shift register 161 is used to store the frame number in the frame counter 37, or the shift register 175 (FIG. 19) or 193 (FIG. 21) is used to store the harmonic coefficient data S2 in the forming circuit 24, as shown in FIGS. 1, 12, 14 and 18. However, a RAM or another memory means may be used in place of the shift register.

(9) In the above arrangement, hardware is provided to perform arithmetic control and arithmetic operations such as addition, accumulation, multiplication or the like. However, software may be utilized together with a microcomputer or the like.

(10) In the above embodiments, the musical tone waveshape is formed by the harmonic combination in a real time. However, a non-real time system may be employed such that the musical tone waveshape formation (harmonic combination) results are stored in a memory, the desired data are read out in correspondence with the musical tone frequency, and a plurality of musical tone waveshape formation cycles are performed to change the tone color during one tone. A typical example of the non-real time system is disclosed in U.S. Pat. No. 3,823,390.

(11) In the above embodiments, the calculations of the respective harmonic coefficient data are synchronized with generation timings thereof. However, as described in U.S. Pat. No. 4,132,140, the calculations of the respective harmonic coefficient data may be asynchronous with the generation timings thereof at a low speed.

(12) In the above embodiments, the interpolation of the harmonic coefficient data for each period of the musical tone waveshape is performed by the forming circuit 24. However, interpolation may be performed for every two or four periods of the musical tone waveshape to obtain the same effect as described above.

(13) The data stored in the basic coefficient memory 21, the difference coefficient generating circuits 22, 22XA and 22XA (FIGS. 1, 14, 18 and 21), the interpolating difference coefficient generating circuit 27 (FIGS. 12), and the difference coefficient memory 167 (FIG. 19) or 181 (FIG. 20) are not limited to PCM data but can be extended to other coded data such as DPCM data, ADPCM data, DM data, ADM data and APCM data.

(14) In the above embodiments, the repetition number designating circuit 34 is arranged in the frame data generating circuit 31 to set the repetition numbers in units of frames. However, a single repetition number can be commonly provided for all frames. In this case, the frame data generating circuit 31 may divide the carry signal CA, and the resultant frequency-divided signal may be supplied to the gate circuit 36.

(15) In the above embodiments, the harmonic combining operation is time-divisionally performed. However, as described in U.S. Pat. No. 3,821,714, the respective harmonic components and the respective harmonic coefficients may be generated parallel with each other for each order.

(16) In the above embodiments, a sinusoid wave is generated from the sinusoid table 4. However, the type of waveshape is not limited to the sinusoid, but can be extended to a rectangular, triangular or other waveshapes which are subjected to harmonic combination.

(17) In the above embodiments, the present invention is applied to the case wherein the musical tone having a pitch corresponding to the depressed key is to be generated. However, the present invention is not limited to such an application, but can be extended to a system for generating rhythmic sounds.

(18) In the above embodiments, in addition to the effect wherein the tone color is changed from the attack to the decay, when a tone color change is added by key scaling, touch response, an operation switch or the like, a multiplier may be connected to the output terminal of the forming circuit 24 for generating the difference accumulation data. The difference accumulation data is weighted in correspondence with key scaling or touch response. The weighted difference accumulation data is added to the basic harmonic coefficient. With this arrangement, the tone color can be easily changed as needed without impairing the image of the original tone by using mainly the basic harmonic coefficients.

(19) In the embodiment of FIG. 12, the interpolating difference data stored in the interpolating difference coefficient generating circuit 27 comprises a value (i.e., $\Delta SP/K$) obtained by dividing the difference between the first harmonic coefficients of each two adjacent frames. By accumulating the interpolating difference data, the difference accumulation data is obtained. However, the difference (i.e., $\Delta SP$) of the harmonic coefficient data is stored without modification in the same manner as in the embodiment of FIG. 1. The difference $\Delta SP$ may be multiplied with an interpolating coefficient (e.g., CV/K) which is continuously changed from 0 to 1, and the resultant value is added to the last harmonic coefficient of the immediately preceding frame.

(20) In the embodiment of FIG. 19, the difference coefficient data corresponding to a difference between the amplitude coefficient generated at the beginning of the given frame and the basic coefficient data is stored in the interpolating coefficient memory in units of orders. The difference coefficient data is read out in response to the output from the frame designating means. However, in the same manner as in FIG. 1, the difference coefficient data corresponding to the difference between the amplitude coefficient generated at the beginning of the given frame and the amplitude coefficient generated at the beginning of the next frame is stored in units of orders. At the same time, the mixing coefficient which is changed over time throughout the frames is multiplied with the difference data. In addition, the data representing the mixing result at the end of each frame is temporarily stored in units of orders. The temporarily stored data, the mixing result and the basic coefficient data of the same order may be added to obtain the amplitude coefficient of the same order, thereby obtaining the same result as in FIG. 19.

In a low-cost harmonic combination type musical tone signal generating apparatus according to the present invention, the sampled values obtained by discrete sampling are sequentially interpolated to obtain continuously changing coefficient data of each order, so that the memory capacity can be greatly decreased as compared with that of the conventional apparatus.

What is claimed is:

1. A musical tone signal generating apparatus of a harmonic combination type, comprising:

harmonic waveshape generating means for generating first to Nth (where N is an integer of 2 or more) order harmonic waveshapes constituting a musical tone signal to be produced;

memory means for storing, (i) a basic coefficient, and (ii) a non-zero difference coefficient whose value is not zero among second to Mth (where M is an integer of 2 or more) difference coefficients together with order data representing order of said non-zero difference coefficient, with respect to each of first to Nth harmonic coefficients, which are functions of time, corresponding to said first to Nth order harmonic waveshapes respectively, each of said first to Nth harmonic coefficients being divided into first to Mth frames along a time axis, and said basic coefficient and the Kth (where K is an integer greater than or equal to 2 and less than or equal to M) difference coefficient respectively having a value representing said first frame and corresponding to the difference between values representing the Kth and (K−1)th frames;

frame designating means for sequentially designating one among said first to Mth frames;

readout means connected to said memory means for reading out said basic coefficient and said non-zero difference coefficient corresponding to the designated frame by said designating means;

forming means for forming each of first to Nth new harmonic coefficients in accordance with said basic coefficient and said non-zero difference coefficient;

multiplying means for multiplying said first to Nth order harmonic waveshapes in accordance with said first to Nth new harmonic coefficients respectively and outputting first to Nth multiplication results; and musical tone signal forming means for adding said first to Nth multiplication results to form a musical tone signal corresponding to said musical tone signal to be produced.

2. An apparatus according to claim 1, wherein said forming means comprises adding means for sequentially adding said basic coefficient and said non-zero difference coefficient corresponding to said second frame to said designated frame with respect to each of the first to Nth orders.

3. An apparatus according to claim 1, wherein said memory means stores a modified non-zero difference coefficient having a value obtained by modifying the value of said non-zero difference coefficient, and which further comprises: interpolating means for performing interpolation operation based on said basic coefficient and said modified non-zero difference coefficient so that the value of each of said first to Nth coefficients changes smoothly from the previous frame to said designated frame.

4. An apparatus according to claim 1, which further comprises a tone color selector, said basic coefficient and said non-zero difference coefficient which are stored together with said order data in said memory means being stored in correspondence with one of the tone colors which is selected by said tone color selector.

5. An apparatus according to claim 1, which further comprises an order number counter, the harmonic waveshapes generated from said harmonic waveshape generating means being designated by an output from said order number counter, said basic coefficient and said non-zero difference coefficient which are accessed by the output from said order number counter being read out in accordance with said designated frame.

6. A musical tone signal generating apparatus of a harmonic combination type, comprising:

harmonic waveshape generating means for generating first to Nth (where N is an integer of 2 or more) order harmonic waveshape constituting a musical tone signal to be produced;

memory means for storing, (i) a basic coefficient, and (ii) a non-zero difference coefficient whose value is not zero among second to Mth (where M is an integer of 2 or more) difference coefficients together with order data representing order of said non-zero difference coefficient, with respect to each of first to Nth harmonic coefficients, which are functions of time, corresponding to said first to Nth order harmonic waveshapes respectively, each of said first to Nth harmonic coefficients being divided into first to Mth frames along a time axis, and said basic coefficient and the Kth (where K is an integer greater than or equal to 2 and less than or equal to M) difference coefficient respectively having a value representing said first frame and corresponding to the difference between values representing the Kth and (K−1)th frames;

frame designating means for sequentially designating one among said first to Mth frames;

readout means connected to said memory means for reading out said basic coefficient and said non-zero difference coefficient corresponding to the designated frame by said designating means;

forming means for forming each of first to Nth new harmonic coefficients in accordance with said basic coefficient and said non-zero difference coefficient;

a mixer for mixing the new harmonic coefficient of the previous frame which is formed by said harmonic coefficient forming means and the new harmonic coefficient of said designated frame with respect to said first to Nth orders to form first to Nth mixed harmonic coefficients;

multiplying means for multiplying each of said first to Nth mixed harmonic coefficients in accordance with a corresponding one of said first to Nth harmonic waveshapes and outputting first to Nth multiplication results; and musical tone signal forming means for adding said first to Nth multiplication results to form a musical tone signal corresponding to said musical tone signal to be produced.

7. An apparatus according to claim 6, wherein values of said first to Nth mixed harmonic coefficients are changed from values of said first to Nth harmonic coefficients of the previous frame to values of said first to Nth harmonic coefficients of said designated frame respectively.

8. An apparatus according to claim 6, wherein said forming means comprises adding means for sequentially adding said basic coefficient and said non-zero difference coefficient corresponding to said second frame to said designated frame with respect to each of the first to Nth orders.

9. An apparatus according to claim 6, which further comprises a tone color selector, said basic coefficient and said non-zero difference coefficient which are stored together with said order data in said memory means being stored in correspondence with one of the tone colors which is selected by said tone color selector.

10. An apparatus according to claim 6, which further comprises an order number counter, the harmonic waveshape generated from said harmonic waveshape generating means being designated by an output from said order number counter, said basic coefficient and said non-zero difference coefficient which are accessed by the output from said order number counter being read out in accordance with said designated frame.

11. A musical tone signal generating apparatus of a harmonic combination type, comprising:

harmonic waveshape generating means for generating first to Nth (where N is an integer of 2 or more) order harmonic waveshapes constituting a musical tone signal to be produced;

memory means for storing, (i) a basic coefficient, and (ii) a non-zero difference coefficient whose value is not zero among second to Mth (where M is an integer of 2 or more) difference coefficients together with order data representing order of said non-zero difference coefficient, with respect to each of first to Nth harmonic coefficients, which are functions of time, corresponding to said first to Nth order harmonic waveshapes respectively, each of said first to Nth harmonic coefficients being divided into first to Mth frames along a time axis, and said basic coefficient and the Kth (where K is an integer greater than or equal to 2 and less than or equal to M) difference coefficient respectively having a value representing said first frame and corresponding to the difference between values representing the Kth and (K−1)th frames;

frame designating means for sequentially designating one among said first to Mth frames;

readout means connected to said memory means for reading out said basic coefficient and said non-zero difference coefficient corresponding to the designated frame by said designating means;

forming means for forming each of first to Nth new harmonic coefficients in accordance with said basic coefficient and said non-zero difference coefficient;

multiplying means for multiplying said first to Nth order harmonic waveshapes in accordance with said first to Nth new harmonic coefficients of the previous frame to output first to Nth previous multiplication results, and for multiplying said first to Nth order harmonic waveshapes in accordance with said first to Nth new harmonic coefficients of said designated frame to output first to Nth current multiplication results;

a mixer for mixing each of said first to Nth previous multiplication results corresponding to one of said first to Nth current multiplication results to output first to Nth new multiplication results; and musical tone forming means for adding said first to Nth new multiplication results to form a musical tone signal corresponding to said musical tone signal to be produced.

12. An apparatus according to claim 11, wherein each of said first to Nth multiplication results is changed from a current multiplication result of the previous frame to a multiplication result of said designated frame.

13. An apparatus according to claim 11, wherein said forming means comprises adding means for sequentially adding said basic coefficient and said non-zero difference coefficient corresponding to said second frame to said designated frame with respect to each of the first to Nth orders.

14. An apparatus according to claim 11, which further comprises a tone color selector, said basic coefficient and said non-zero difference coefficient which are stored together with said order data in said memory means being stored in correspondence with one of the tone colors which is selected by said tone color selector.

15. An apparatus according to claim 11, which further comprises an order number counter, the harmonic waveshape generated from said harmonic waveshape generating means being designated by an output from said order number counter, said basic coefficient and said non-zero difference coefficient which are accessed by the output from said order number counter being read out in accordance with said designated frame.

16. A musical tone signal generating apparatus of a harmonic combination type, comprising:

harmonic waveshape generating means for generating first to Nth (where N is an integer of 2 or more) order harmonic waveshapes constituting a musical tone signal to be produced;

memory means for storing, (i) a basic coefficient, and (ii) second to Mth (where M is an integer of 2 or more) difference coefficients together with order data representing order of a non-zero difference coefficient, with respect to each of first to Nth harmonic coefficients, which are functions of time, corresponding to said first to Nth order harmonic waveshapes respectively, each of said first to Nth harmonic coefficients being divided into first to Mth frames along a time axis, and said basic coefficient and the Kth (where K is an integer greater than or equal to 2 and less than or equal to M) difference coefficient respectively having a value representing said first frame and corresponding to the difference between values representing the Kth and (K−1)th frames;

frame designating means for sequentially designating one among said first to Mth frames;

forming means for forming each of first to Nth new harmonic coefficients in accordance with said basic coefficient and said non-zero difference coefficient;

multiplying means for multiplying each of said first to Nth harmonic waveshapes in accordance with a corresponding one among said first to Nth new harmonic coefficients and outputting first to Nth multiplication results; and musical tone signal forming means for adding said first to Nth multiplication results to form a musical tone signal corresponding to said musical tone signal to be produced.

17. An apparatus according to claim 16, wherein said memory means stores a modified non-zero difference coefficient having a value obtained by modifying the value of said non-zero difference coefficient, and which further comprises: interpolating means for performing interpolation operation based on said basic coefficient and said modified non-zero difference coefficient so that the value of each of said first to Nth coefficients changes smoothly from the previous frame to said designated frame.

18. An apparatus according to claim 16, wherein said forming means comprises adding means for sequentially adding said basic coefficient and said second difference coefficient to the difference coefficient of said designated frame with respect to each of said first to Nth order waveshapes.

19. An apparatus according to claim 16, which further comprises a tone color selector, said basic coefficient and said non-zero difference coefficient which are stored together with said order data in said memory means being stored in correspondence with one of the tone colors which is selected by said tone color selector.

20. An apparatus according to claim 16, which further comprises an order number counter, the harmonic waveshape generated from said harmonic waveshape generating means being designated by an output from said order number counter, said basic coefficient and said non-zero difference coefficient which are accessed by the output from said order number counter being read out in accordance with said designated frame.

21. A musical tone signal generating apparatus of a harmonic combination type, comprising:

harmonic waveshape generating means for generating first to Nth (where N is an integer of 2 or more) order harmonic waveshapes constituting a musical tone signal to be produced;

memory means for storing, (i) a basic coefficient whose value is predetermined, and (ii) first to Mth (where M is an integer of 2 or more) difference coefficients, with respect to each of first to Nth harmonic coefficients, which are functions of time, corresponding to said first to Nth order harmonic waveshapes respectively, each of said first to Nth harmonic coefficients being divided into first to Mth frames along a time axis, and the Kth (where K is an integer greater than or equal to 1 and less than or equal to M) difference coefficient having a value corresponding to the difference between said predetermined value and the value representing the Kth frame;

frame designating means for sequentially designating one among said first to Mth frames;

forming means comprising adding means for adding said basic coefficient and the difference coefficient of said designated frame with respect to the first to Nth orders;

multiplying means for multiplying said first to Nth order harmonic waveshapes in accordance with said first to Nth new harmonic coefficients respectively and outputting first to Nth multiplication results; and musical tone signal forming means for adding said first to Nth multiplication results to form a musical tone signal corresponding to said musical tone signal to be produced.

* * * * *